US011236772B2

(12) United States Patent
Sargesjan et al.

(10) Patent No.: US 11,236,772 B2
(45) Date of Patent: Feb. 1, 2022

(54) PNEUMATIC ACTUATOR AND PORTABLE TOOL

(71) Applicant: Armen Sargesjan, Kuringen (BE)

(72) Inventors: Armen Sargesjan, Kurigan (BE); Gabriël Meers, Deurne (BE); Wesley Devries, Tongeren (BE)

(73) Assignee: Armen Sargesjan, Kuringen (BE)

( * ) Notice: Subject to any disclaimer, the term of this patent is extended or adjusted under 35 U.S.C. 154(b) by 11 days.

(21) Appl. No.: 16/962,953

(22) PCT Filed: Jan. 8, 2019

(86) PCT No.: PCT/IB2019/050131
§ 371 (c)(1),
(2) Date: Jul. 17, 2020

(87) PCT Pub. No.: WO2019/145800
PCT Pub. Date: Aug. 1, 2019

(65) Prior Publication Data

US 2021/0131457 A1 May 6, 2021

(30) Foreign Application Priority Data

Jan. 23, 2018 (BE) ..... 2018/5035

(51) Int. Cl.
*B25B 5/06* (2006.01)
*F15B 15/20* (2006.01)

(52) U.S. Cl.
CPC ..... *F15B 15/20* (2013.01); *B25B 5/061* (2013.01)

(58) Field of Classification Search
CPC .. F15B 1/265; F15B 2211/7052; F15B 15/20; F15B 15/202; F15B 2211/324; F15B 2211/321; B25B 5/061; B25B 5/067
See application file for complete search history.

(56) References Cited

U.S. PATENT DOCUMENTS 3,636,748 A * 1/1972 Hall ..... B21D 24/14 72/349
4,409,720 A * 10/1983 Boudreau ..... B30B 1/32 29/243.5

(Continued)

FOREIGN PATENT DOCUMENTS

BE 1010202 A3 3/1998
DE 3622687 A1 4/1987

(Continued)

OTHER PUBLICATIONS

International Search Report and Written Opinion dated May 31, 2019 in International Application No. PCT/IB2019/050131 filed Jan. 8, 2019.

*Primary Examiner* — Thomas E Lazo
(74) *Attorney, Agent, or Firm* — Dinsmore & Shohl LLP

(57) ABSTRACT

A pneumatic actuator (240), comprising: a pressure reducer (270) for delivering gas under a reduced pressure to a control valve; the control valve (280) selectively supplying gas to a pneumatic cylinder (290) or discharging gas from the cylinder (290) to the environment; a replaceable gas capsule (260) for supplying the gas under increased pressure; where the actuator has a first mode of operation for moving the piston (293) to the extended position, and has a second mode of operation for retracting the piston (293). A method for assembling a pneumatic actuator. A portable tool, a clamping device, a screw clamp comprising such a pneumatic actuator. A method for assembling the screw clamp. A method for repairing the screw clamp.

20 Claims, 19 Drawing Sheets

(56) References Cited

U.S. PATENT DOCUMENTS

| | | | | | |
|---|---|---|---|---|---|
| 4,768,820 | A * | 9/1988 | Barone | B63C 11/50 | 294/66.1 |
| 4,819,921 | A * | 4/1989 | Takahashi | B25B 1/12 | 269/160 |
| 5,427,364 | A | 6/1995 | Zborschil | | |
| 5,503,137 | A * | 4/1996 | Fusco | F41B 11/62 | 124/56 |
| 6,123,326 | A | 9/2000 | Kleinbongartz | | |
| 6,896,248 | B1 * | 5/2005 | Andulics | B25B 5/061 | 269/3 |
| 9,468,204 | B2 * | 10/2016 | Bond | A01M 27/00 | |
| 9,505,495 | B2 * | 11/2016 | Tobias | B64D 1/02 | |

FOREIGN PATENT DOCUMENTS

| | | | |
|---|---|---|---|
| DE | 19632851 | A1 | 2/1997 |
| DE | 102010051155 | A1 | 8/2012 |
| FR | 2615888 | A1 | 12/1988 |
| FR | 2651299 | A1 | 3/1991 |
| WO | 2011018238 | A2 | 2/2011 |

* cited by examiner

PNEUMATIC ACTUATOR AND PORTABLE TOOL

FIELD OF THE INVENTION

The present invention relates to a pneumatic actuator, and to tools having such an actuator, more specifically a portable screw clamp having such an actuator.

BACKGROUND OF THE INVENTION

Pneumatic actuators are known in the art. They are usually used in an automatic production line for moving objects, in which they are provided with compressed air via a supply line coupled with a compressor.

Screw clamps, also known as glueing clamps or glueing cramps, are also known in the art. They are widely used in the metal industry and in building construction, to clamp parts prior to welding them or drilling them or otherwise attaching them. Existing screw clamps have a guide profile with a fixed arm and a movable arm, the movable arm being slidable over the guide profile, and the movable arm having a screw clamp for clamping workpieces. When clamping, the movable arm is typically first slid towards the fixed arm against the workpieces, and subsequently the screw clamp is manually screwed tight.

Such screw clamps are described, for example, in U.S. Pat. Nos. 5,427,364A and 6,123,326A. BE1010202A3 en FR2615888A1 describe screw clamps wherein the fixed arm has a pointed end.

SUMMARY OF THE INVENTION

It is an object of embodiments of the present invention to provide a pneumatic actuator which can be used in a portable tool, more specifically a freestanding tool (i.e. non-coupled to a supply line) and a tool that can be carried in one hand, and a method for assembling such an actuator.

It is an object of embodiments of the present invention to provide a portable tool (e.g. a screw clamp) which can be operated with one hand, and a method for assembling such a tool, and a method for repairing such a tool.

It is an object of embodiments of the present invention to provide a portable tool (e.g. a screw clamp) which can be quickly clamped.

It is an object of embodiments of the present invention to provide a portable tool (e.g. a screw clamp) which can be quickly released.

It is an object of embodiments of the present invention to provide a portable tool (e.g. a screw clamp) which can be clamped with a pre-adjustable force.

For this purpose, the present invention provides a pneumatic actuator, and a tool comprising such a pneumatic actuator, and a method for assembling such a tool, and a method for repairing such a tool, according to embodiments of the present invention.

According to a first aspect, the present invention provides a pneumatic actuator, comprising: a replaceable gas capsule having a capsule outlet, for supplying a gas under elevated pressure; a pressure reducer connected with an outlet of the gas capsule, adapted for delivering gas under a reduced pressure; a control valve connected with an outlet of the pressure reducer for receiving the gas under reduced pressure, having a first outlet for selectively supplying the gas to a pneumatic cylinder, and having a second outlet for selectively discharging the gas from the cylinder into the environment; the pneumatic cylinder having a piston which is movable from a retracted position to an extended position.

It is an advantage of such an actuator that it can work on its own, and thus does not need to be connected to a compressor via a hose. This makes the actuator extremely suitable for portable applications.

It is an advantage that the actuator converts pressure force from the gas capsule into a linear movement with a certain force. This makes the actuator extremely suitable for application in a screw clamp or a stut or the like.

It is an advantage that a pressure reducer is used, because as a result (during activation) not the full pressure of the gas capsule is supplied to the pneumatic cylinder, but only a lower pressure. As a result, the pressure force exerted by the pneumatic cylinder can deliberately remain limited, and the number of activations can also be increased.

Preferably the pressure reducer comprises at least one movable element.

Preferably the pressure reducer comprises at least a first compartment fluidly connected with a second compartment via a passage, which passage is closable by means of a valve, which valve is connected with a membrane and with at least one spring, and where the membrane and the valve and the at least one spring are arranged such that the valve opens when pressure in the second compartment is less than a predefined or pre-set pressure, and that the valve closes when pressure in the second compartment is greater than the predefined pressure.

The gas capsule preferably contains $CO_2$ at a pressure of at least 20 bar. $CO_2$ is a non-combustible gas. This offers the advantage that the risk of explosion upon normal use is minimal.

The pressure reducer preferably has an inlet for receiving gas under increased pressure, and an outlet for delivering gas under a reduced pressure.

The control valve preferably has an inlet fluidly connected with the outlet of the pressure reducer, and preferably has a first outlet for supplying the gas under the reduced pressure, and a second outlet to the environment.

The pneumatic cylinder preferably has a cylinder inlet fluidly connected with the first outlet of the control valve, and a piston which is movable from a retracted position to an extended position.

The gas capsule preferably has a capsule outlet connected with the inlet of the pressure reducer, for supplying the gas under increased pressure.

Preferably in the first mode of operation the inlet of the control valve is fluidly connected with its first outlet for moving the piston from the retracted to the extended position.

Preferably the actuator has a first mode of operation for moving the piston from the retracted to the extended position, and a second mode of operation for retracting the piston.

Preferably in the second mode of operation the first outlet of the control valve is fluidly connected with its second outlet for letting the gas escape from the pneumatic cylinder into the environment.

In an embodiment, the pressure reducer is an adjustable pressure reducer, and the pressure reducer has an adjustment knob for adjusting a pressure at the outlet of the pressure reducer.

It is a strong advantage to provide an adjustable pressure reducer, in contrast to a pressure reducer with an unadjustable pressure, because this allows the force of the pneumatic cylinder, more particularly of the piston, to be made adjustable, dependent on the application. This is advantageous, for example, when the actuator is used in a clamp of a screw clamp or the like, because this allows the user to adjust the force with which objects are clamped, for example sufficiently large (e.g. greater than a certain threshold of e.g. 100 Newton) so that the clamped objects do not come loose, and sufficiently small (e.g. smaller than a certain threshold of e.g. 2500 Newton) in order not to damage the objects.

The adjustable pressure reducer may have a similar structure as a reducing valve. And even though it is known to position a reducing valve between two lines in which a gas is flowing continuously, as for supplying a combustible gas to a gas fire from a gas bottle, to prevent shocks, it is not known to use a reducing valve for a discontinuous application in which only very briefly a small amount of gas has to be supplied at once. And neither is it known to incorporate a reducing valve in an actuator which can be carried in and be controlled by a single hand.

It has proved surprising that it is possible to construct a very compact adjustable pressure reducer which fits in an imaginary cylinder having a diameter of 5 cm and a height of 5 cm, but also that such a pressure reducer works surprisingly well for reducing pressure of short discrete loads originating from a gas capsule with a relative high pressure (e.g. more than 20 bar, or even more than 25 bar, or even more than 30 bar).

In an embodiment, the pneumatic cylinder comprises a cylinder wall having an internal diameter of 30 to 60 mm, and a piston which is movable with respect to the cylinder wall.

It is an advantage of such a diameter that, when a pressure of about 2 to 20 bar is exerted on it, the piston can supply a force of about 141 to about 5652 Newton.

In an embodiment, the pneumatic cylinder has a piston stroke in the range from 3 mm to 15 mm, e.g. from 5 to 12 mm, e.g. equal to about 6 mm or about 8 mm or about 10 mm.

In an embodiment, the pneumatic cylinder is a single-acting pneumatic cylinder, with a spring for at least partially pushing back the piston.

The spring may be a cup spring. It is an advantage to use a cup spring, because these are significantly smaller and more powerful than a coil spring of the same outer diameter. As a result, the space needed to contain the spring can be strongly reduced, which benefits the compactness. A cup spring is especially advantageous in combination with a small piston stroke.

The spring may also be a classical cylindrical spring.

It is an advantage to use a single-acting cylinder instead of a double-acting cylinder, because this simplifies the design of the actuator significantly.

Even though the present invention can also work without a spring to push the piston back inside (in this case the user can push the piston back manually, for example), the spring offers the advantage that the piston is at least partially pushed back automatically. As a result, the actuator can be deactivated faster and more easily. Without the presence of the spring, a hammer is needed to relax the bracket, even when the piston is no longer actively pushing.

In an embodiment, the outlet of the gas capsule is fluidly connected with the inlet of the pressure reducer via a transition element (adapter); and the pressure reducer has an internal screw thread for attaching the transition element, and the transition element comprises a corresponding external screw thread; and the transition element further comprising an internal screw thread for attaching the gas capsule, and the gas capsule comprising a corresponding external screw thread; and the transition element further comprising a puncture element for puncturing a part of the gas capsule during the mounting of the gas capsule in the transition element, and the puncture element being fluidly connected with the inlet of the pressure reducer.

It is a major advantage to make the transition element as a separate component, because this allows other materials to be used for the reducing valve on the one hand, and the transition element on the other hand. As a result, the properties of the elements can be optimised separately.

This further offers the advantage that the transition element is replaceable. This is advantageous because the internal screw thread and the puncture element of the transition element in particular are subject to wear.

In an embodiment, the transition element is made of nitride steel, and the pressure reducer comprises polyethylene.

It is an advantage of nitride steel that it can be hardened.

In an embodiment, the cylinder wall and the piston of the pneumatic cylinder are made of aluminium or an aluminium alloy.

This offers the advantage that the pneumatic cylinder can be implemented both lightweight as well as very strong.

The aluminium alloy is preferably an AlMgSi alloy. This alloy has the advantage that it can be hardened.

In an embodiment, the pneumatic actuator has internal channels having a diameter of at most 8 mm, e.g. about 7 mm, or about 6 mm, or about 5 mm, or about 4 mm, or about 3 mm.

Such channels are, on the one hand, sufficiently large to limit the pressure loss upon passage of gas, and constitute, on the other hand, a sufficiently small space to limit the amount of gas consumed per activation and deactivation.

By choosing channels of 6 mm instead of 8 mm, the number of activations (for a given gas capsule and set pressure force) can be increased. On the other hand, to limit pressure loss, the channels should not be too small, especially if there are bends.

In an embodiment, the gas capsule is surrounded by a cylinder-shaped metal casing of at least 1.5 mm thickness, with an external diameter of 45 mm to 65 mm.

In a preferred embodiment, the outer diameter is about 50 mm or about 60 mm or about 55 mm thick. Such a cylinder can be firmly held in the hand.

The metal is preferably aluminium or an aluminium alloy, e.g. an AlMgSi alloy.

Such metal casing also offers extra protection to the user against the unwanted disengagement of some part of the actuator under high pressure. By doing this, the risk of possible injuries is strongly reduced.

In an embodiment, the gas capsule is surrounded by a thermal insulation provided within the aluminium casing.

The thermal insulation may help to prevent burn injuries which might occur upon direct contact of the human skin with the gas capsule, because ice formation could occur around the gas capsule if it is used regularly.

In an embodiment, the control valve has an internal space which is in fluid connection with the first outlet of the control valve; and the control valve further comprises one single slidable control pin to connect the internal space with either the inlet of the control valve corresponding to the first mode of operation, or with the second outlet of the control valve corresponding to the second mode of operation.

It is an advantage of such a control valve that the piston of the pneumatic cylinder is permanently under increased pressure (e.g. a pressure of 2 to 20 bar) when the control pin is in the first position, so that any small pressure losses can be supplemented from the capsule.

This operation is also easy to understand for a user.

The control pin can be a cylinder-shaped pen, for example, arranged in transversal direction with respect to the control valve, and may have a variable diameter.

In an embodiment, the control valve comprises a first depressible control pin for connecting the inlet of the control valve and the first outlet of the control valve, and a first spring for pushing the first control pin back to a position where the first outlet is closed off from the inlet; and the control valve further comprises a second depressible control pin for connecting the first outlet and the second outlet of the control valve, and a second spring for pushing the second control pin back to a position where the first outlet is closed off from the second outlet; and where the first mode of operation corresponds to the first control pin being in the depressed position and the second control pin being in pushed-back position; and where the second mode of operation corresponds to the second control pin being in the depressed position and the first control pin being in the pushed-back position.

By 'depressed position' is meant the position where the pen is pushed inwards. By 'pushed-back position' is meant the position where the pen is pushed outwards.

In an embodiment, the pneumatic actuator is implemented such that for each activation and deactivation less than 25 ml gas from the gas capsule is used, e.g. less than 20 ml.

It is an advantage that the pneumatic actuator can be implemented very compactly, so that it can quite easily be held in a single hand.

It is an advantage that the internal space of the pneumatic actuator is limited; the smaller the space, the more activations are possible with a given gas capsule.

In an embodiment, the pneumatic actuator without the gas capsule has a mass of less than 700 grams, e.g. less than 650 grams, e.g. less than 600 grams.

Such an actuator is extremely suitable for use in tools which must be operable with a single hand, even in an overhead position.

According to a second aspect, the present invention provides a method for assembling a pneumatic actuator according to the first aspect, the method comprising the steps of: providing a body comprising a pressure reducer and a control valve; inserting at least one control pin and at least one ball or first element having a collar (or flange) and at least one spring in a first opening of the body; sealing the opening at the side of the spring; screwing in a hardened transition element in the body; heating a first aluminium casing, and applying it in heated state around the body, and crimping it.

In an embodiment, the method further comprises the step of inserting at least a second control pin and at least a second ball or a second element having a collar, and at least a second spring in a second opening of the body.

In an embodiment, the method further comprises the steps of: applying a second metal casing against the body, for surrounding the space configured for accommodating the gas capsule.

Preferably the metal is aluminium or an aluminium alloy.

Preferably the second metal casing is attached by means of a threaded connection around the place where the gas capsule is contained.

According to a third aspect, the present invention provides a clamping device with a pneumatic actuator according to the first aspect; and with a first arm forming part of a guide profile or to which a guide profile is connected, the guide profile having a linear part; and a second arm movably attached to the linear part of the guide profile, the second arm having two through-openings; and the first arm and the second arm extending substantially perpendicular with respect to the linear part of the guide profile; and the pneumatic actuator being connected with the second arm and extending in a direction substantially parallel to the linear part of the guide profile for clamping one or more workpieces.

Such a clamping device can also be called a "screw clamp".

Such a screw clamp has the advantage that it can be operated with a single hand, even in an overhead position, as opposed to a classical screw clamp where one hand is needed for holding, and one hand is needed for screwing the tensioning screw of the screw clamp tight. Or in other words, for tasks where with the classical screw clamp 3 or 2 persons were needed to hold and tension the pieces, 2 persons or 1 person can suffice using a screw clamp according to the present invention.

It is an advantage of this "clamping device with pneumatic actuator", herein also called "automatic screw clamp", that a workpiece can be clamped very quickly, much faster than with a classical screw clamp which has to be screwed tight manually.

It is an advantage of embodiments having an adjustable reducing valve that the clamping force can be set easily and can be set beforehand.

In an embodiment, the first arm has a first contact surface, and the pneumatic actuator has a second contact surface for clamping the one or more workpieces between the first and second contact surface.

Flat surfaces offer the advantage (as compared to toothed surfaces for example) that sensitive surfaces, e.g. painted or lacquered surfaces, can be clamped without any or without significant damage.

In an embodiment, the mass of the clamping device amounts to less than 2600 grams, e.g. less than 2400 grams, e.g. less than 2200 grams.

It is an advantage of such a clamping device (e.g. a screw clamp) with such a relatively low weight that it can be easily held with one hand, even in an overhead position. This low weight is achieved by the small dimensions, and by making use of a variety of light materials, among which aluminium or aluminium alloy for the pneumatic cylinder, by making the hardened steel element as small as possible (e.g. by making use of an insert), and by making as much use as possible of plastic material, for example polyethylene, for the remaining components.

In an embodiment, the clamping device further comprises a safety bolt to block the piston.

It is an advantage of the safety bolt that it prevents the piston from moving outwards, because the safety bolt restrains the piston. In this way (under certain circumstances) it can be prevented that a person accidentally clamps his or her fingers.

According to a fourth aspect, the present invention provides a method for assembling a clamping device according to the third aspect, the method comprising the steps of: a) providing a pneumatic actuator according to the first aspect; b) providing a guide profile with a linear part with a first arm forming part of the guide profile; or providing a guide profile with a linear portion, and providing a first arm, and connecting the first arm to the guide profile; c) providing a second arm with a first opening and a second opening; d) connecting the pneumatic actuator to the first opening of the second arm; d) inserting the guide profile through the second opening of the second arm.

In an embodiment, the method further comprises the step of connecting a top unit to the piston or to an extension of the piston.

According to a fifth aspect, the present invention provides a method for repairing a clamping device according to the third aspect, the method comprising the steps of: a) providing a clamping device according to the first aspect; b) if present, removing the gas capsule; c) removing the hardened transition element (or adapter); d) screwing in a new hardened transition element.

This method is extremely suitable for the repair of a clamping device of which the transition element is damaged or worn.

According to a sixth aspect, the present invention provides a tool comprising a pneumatic actuator according to the first aspect, preferably a portable tool.

BRIEF DESCRIPTION OF THE FIGURES

Referring specifically to the figures, it is emphasized that the particulars shown serve only as an example and only for the illustrative discussion of the various embodiments of the present invention. They are represented with the aim of supplying what is considered to be the most useful and immediate description of the principles and conceptual aspects of the invention. In this regard, it is not attempted to show more structural details of the invention than is necessary for a fundamental understanding of the invention. The description in combination with the figures makes it clear for persons skilled in the art how the various forms of the invention can be implemented in practice.

FIG. 5 shows a perspective view of a portion of a preferred embodiment of a pneumatic actuator according to the present invention. The portion shown comprises an adjustable pressure reducer as well as a control valve.

FIG. 6 shows the portion of FIG. 5 in cross-section, from another viewpoint.

FIG. 7 shows the portion of FIG. 5 in another cross-section, through the adjustment knob.

FIG. 8 shows a portion of the screw clamp of FIG. 2 in cross-section.

FIG. 9 shows a portion of the screw clamp of FIG. 2 in another cross-section.

FIG. 10 to FIG. 20 are shown as grayscale drawing as well as line drawing, for illustrative purposes.

FIG. 10 shows a screw clamp and a pneumatic actuator according to the third embodiment.

FIG. 11 to FIG. 18 show intermediate steps of a typical sequence or cycle of clamping and releasing once, to explain the internal operation of the pneumatic actuator.

FIG. 11 shows the internal structure of the pneumatic actuator of FIG. 10 in perspective cross-section, before a gas capsule is mounted. The membrane is pushed inwards (to the right) by the spring of the turning knob.

FIG. 12 shows the pneumatic actuator of FIG. 11 after the gas capsule (not shown) is mounted. The membrane is pushed outwards (to the left) by the pressure of the gas from the gas capsule, until the pressure in the first chamber (to the right of the membrane) is greater than the pressure in the second chamber (left of the membrane), thereby closing the shut-off valve between the first chamber and the second chamber.

FIG. 13 shows the pneumatic actuator of FIG. 12, when viewed from another position. The first and the second push button are not depressed.

FIG. 14 shows the pneumatic actuator of FIG. 13 when the first (lowermost) push button is depressed to activate the actuator. A channel is formed from the second chamber to the piston, causing the latter to move (upwards).

FIG. 15 shows the pneumatic actuator of FIG. 14 after the piston has partly moved (upwards).

FIG. 16 shows the pneumatic actuator of FIG. 15 when the first (lowermost) push button (the activation button) is released. The piston remains in the extended position.

FIG. 17 shows the pneumatic actuator of FIG. 16 when the second (top) push button (the relaxation button) is depressed. The gas in the piston escapes, and the piston is pushed back into the retracted position by a spring (visible in FIG. 18).

FIG. 18 shows the pneumatic actuator of FIG. 17 when the piston is fully retracted back and the second push button is released. This is the same state as shown in FIG. 13, differing in that the gas capsule now contains one charge of gas less.

FIG. 19 shows how the screw clamp can be carried with one single hand.

FIG. 20 shows how the screw clamp can be operated with one single hand.

DETAILED DESCRIPTION OF THE INVENTION

The invention will be further explained on the basis of exemplary embodiments. The invention is not limited hereto however, but only by the claims.

The term "1 bar" corresponds with $10^5$ Pa.

Screw clamps, also referred to as glueing clamps or glueing cramps, already exist for many decades and, as for their principle of operation, have remained substantially unchanged in the course of time. The clamping principle of a screw clamp relies on the one hand on the fact that the movable arm is slightly tilted when clamping, whereby it assumes a fixed position with respect to the guide profile, and on the other hand on shifting a contact surface with respect to the movable arm by means of a screw. When a screw clamp is to be released, the screw must first be screwed loose, and only thereafter can the movable arm be tilted, after which the movable arm can be slid. The screw clamp is a very robust and reliable tool and is used indoors as well as outdoors.

The inventors of the present invention have however realised that two hands are frequently needed to position the screw clamp, to slide the movable arm and to tighten the screw, in addition to the hands needed to temporarily hold the workpieces in their desired position. As a result, two of three persons are sometimes needed. Moreover the inventors have realised that tightening itself sometimes takes too long, especially when, for example, a large force is to be exerted, e.g. to lift up the workpieces.

In view of these problems, the inventors came to the idea of developing a screw clamp with which workpieces can be clamped faster and more easily, and where less hands are needed to tension this screw clamp. More particularly, the inventors came to the idea of developing a portable screw clamp having a pneumatic actuator with a replaceable gas capsule, the underlying idea being that the screw clamp can be tensioned by pressing a button.

Figure 1:
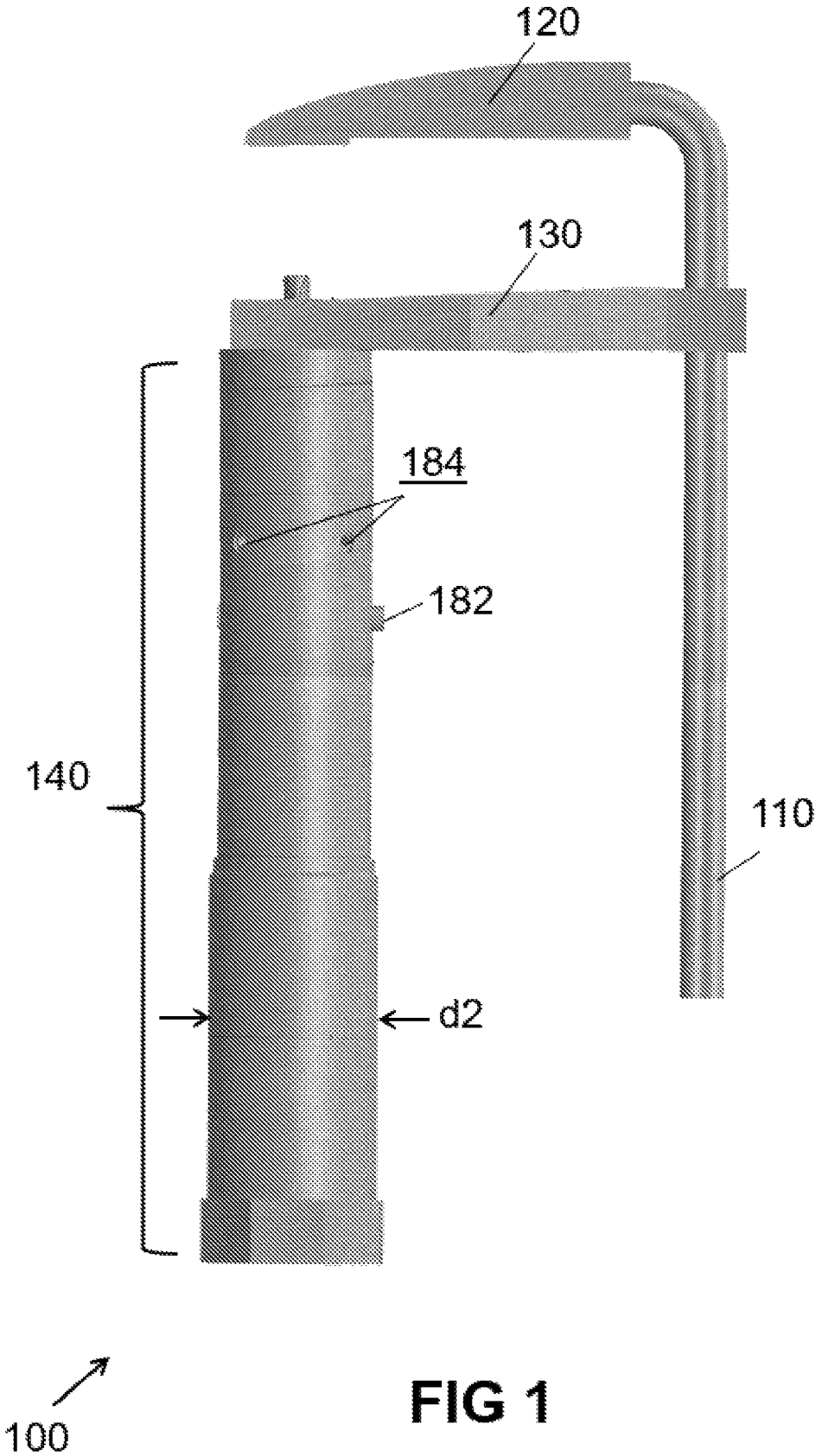
FIG. 1 shows a first embodiment of a pneumatic actuator according to the present invention, and a screw clamp with the pneumatic actuator.

Confronted with this challenge, a first prototype of a screw clamp 100 with a pneumatic actuator 140 was developed and built, shown in FIG. 1. The pneumatic actuator 140 is mainly made of steel and makes use of a gas capsule with $CO_2$-gas under increased pressure (e.g. with a pressure in the range from 20 to 32 bar) to supply gas under high pressure to a pneumatic cylinder. The pneumatic cylinder comprises a single piston and a spring to push the piston back or to pull it back. A portion of the piston protrudes past the second arm 130 for clamping workpieces (not shown). The pneumatic actuator 140 has two modes of operation, namely:

- a first mode of operation where the gas capsule is in fluid connection with an inlet of the pneumatic cylinder, whereby the cylinder will move outwards (towards the first arm 120) for clamping workpieces (not shown); and
- a second mode of operation where the channel of the gas capsule is closed, and the inlet of the pneumatic cylinder is brought into fluid connection with one of more openings 184 to the outside (under atmospheric pressure) so that the gas at the inlet of the piston can escape to the environment, and the spring can push or pull the piston back.

The first prototype 100 (see FIG. 1) was built, but turned out to be less than ideal, and has led to new insights and improvements which will further be described and explained on the basis of FIG. 2 to FIG. 9 as the second prototype 200.

The second prototype was also built and tested, and has led to yet further insights and improvements which will be further described and explained with reference to FIG. 10 to FIG. 20 as the third prototype 300.

As will become clear after reading this document, the principle of operation of the three prototypes is largely the same.

The invention will now be further explained with reference to the figures which describe an exemplary embodiment, without however limiting the invention thereto.

FIG. 1 was already discussed above. It shows the first prototype of a screw clamp 100 with pneumatic actuator 140, attached to the second arm 130 which is slidable over a guide profile 110. In this example, the first arm 120 is unitarily formed with the guide profile 110. One of the disadvantages of the first prototype was that it was too heavy and too large. An additional objective was therefore to make the pneumatic actuator and the screw clamp with the pneumatic actuator as compact as possible.

Figure 2:
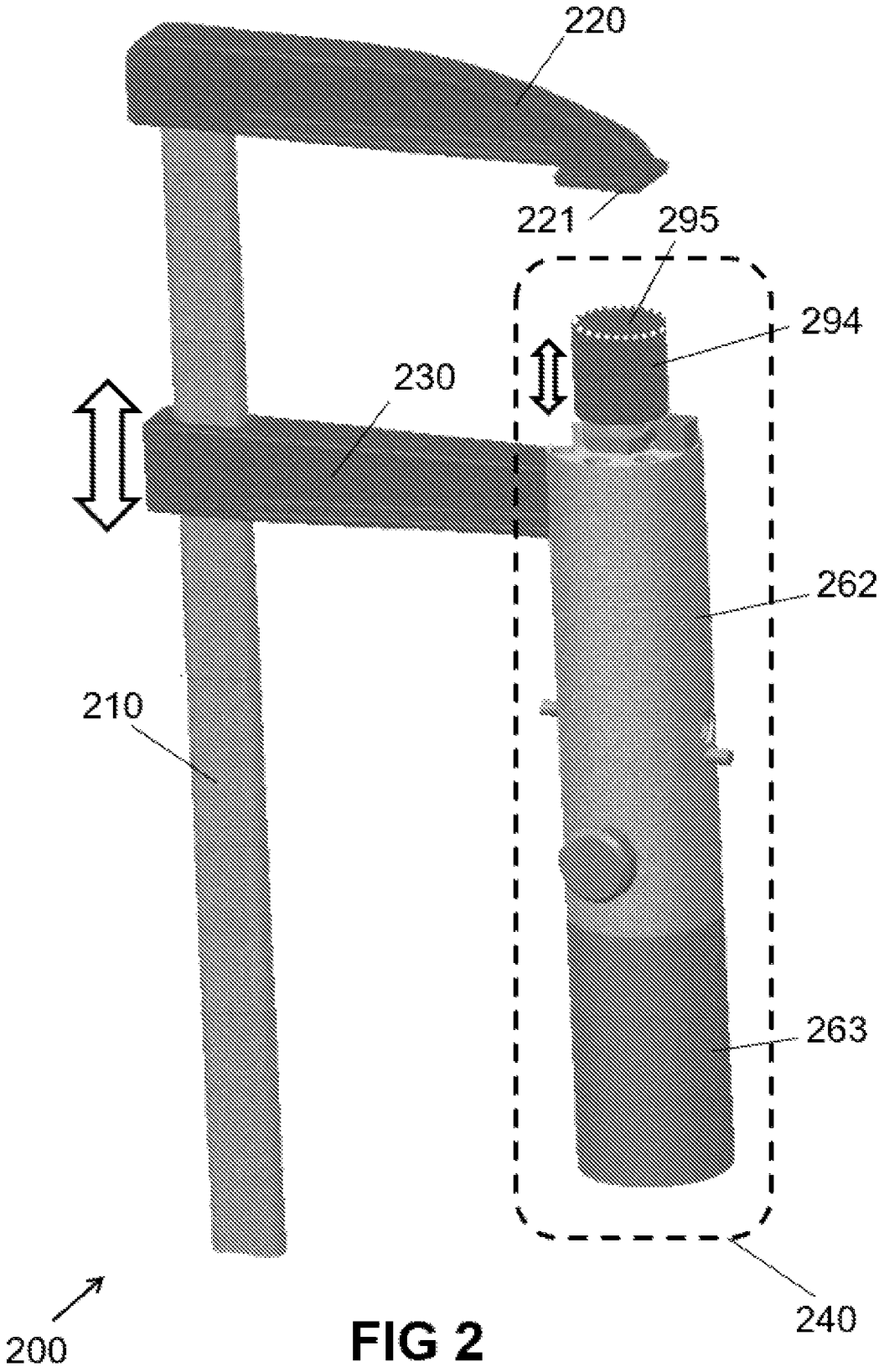
FIG. 2 shows a second embodiment of a pneumatic actuator according to the present invention, and a screw clamp with the pneumatic actuator.

FIG. 2 shows a second embodiment of a pneumatic actuator 240, and a screw clamp 200 comprising the pneumatic actuator. The screw clamp 200 shown further comprises a guide profile 210 to which a first arm 220 is attached, and over which a second arm 230 is slidably mounted. As shown, the first arm 220 comprises a first contact surface 221, and the second arm 230 comprises a second contact surface 295 facing the first contact surface 221, and which is movable with respect to the second arm 230 such that between the first and second contact surface 221, 295 one or more workpieces can be clamped.

In the example of FIG. 2, the top portion (shown in light gray) of the pneumatic actuator 240 is surrounded by a first metal casing 262, herein also called first protective enclosure. This offers as advantage that the tool is safer in use, especially at the control valve (as will become clear further on) but the casing is not necessary for the functional operation.

In the example of FIG. 2, the lowermost portion (shown in dark gray) of the pneumatic actuator 240 is surrounded by a second metal casing 263, herein also referred to as second protective enclosure. This offers as advantage that the tool is safer in use, especially at the gas capsule (as will become clear further on) but also this casing is not absolutely necessary for the functional operation.

These casings 262, 263 can, for example, be made of aluminium or an aluminium alloy, and may, for example, have a wall thickness in the range from 1.0 mm to 3.0 mm, e.g. equal to about 1.5 mm or about 2.0 mm or about 2.5 mm.

On top of the pneumatic actuator 240, a small cap 294 is provided having the contact surface 295. Dependent on the application, this small cap can be made of steel, or of a plastic, e.g. polyethylene. The latter is especially advantageous for clamping sensitive surfaces, e.g. painted or lacquered objects, without scratching them.

Figure 3:
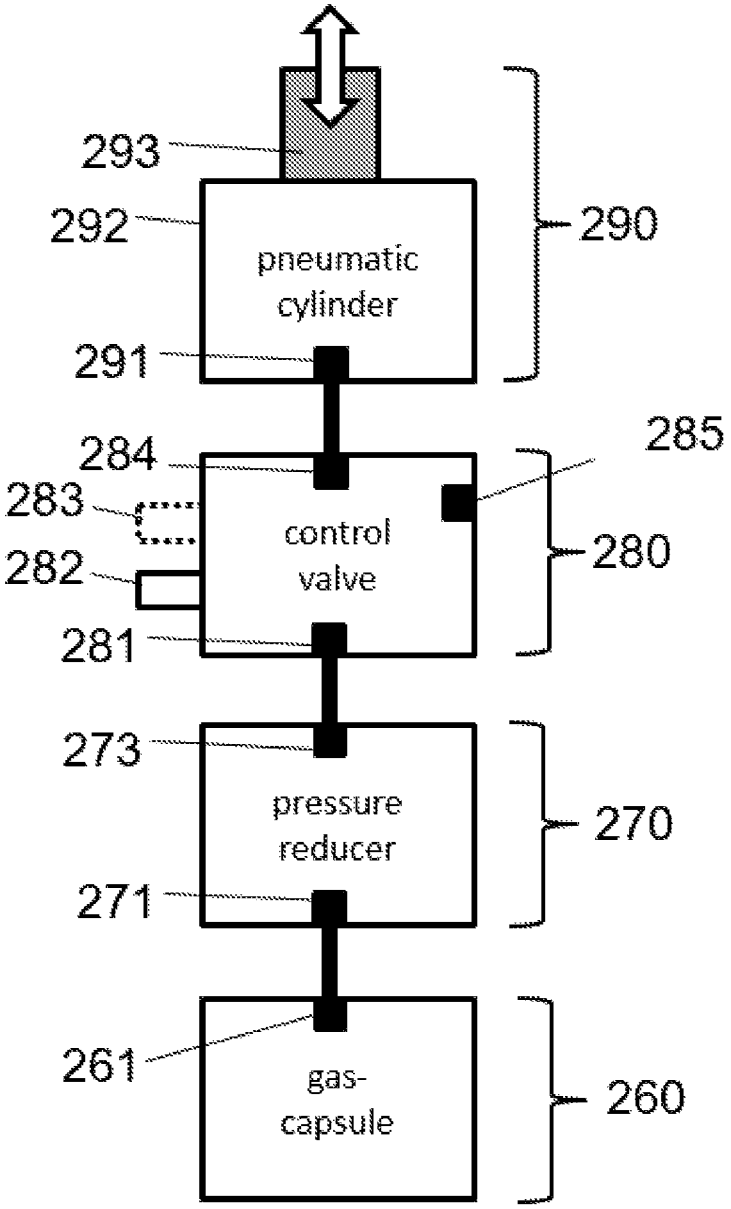
FIG. 3 shows a schematic block diagram of a pneumatic actuator according to the present invention.
Figure 3:
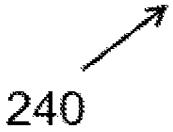

FIG. 3 shows a schematic representation of a pneumatic actuator 240 according to the present invention. As shown, the pneumatic actuator 240 comprises four components:

- a gas capsule 260 for supplying a gas under increased pressure, e.g. $CO_2$ gas under a pressure of 20 to 32 bar;
- a pressure reducer 270, for reducing the pressure of the gas capsule to a lower one, for example predefined pressure in the range from 2 bar to 20 bar, or in the range from 5 bar to 10 bar;
- a control valve 280 with at least two modes of operation as described above;
- a pneumatic cylinder 290 with a piston, e.g. a single-acting cylinder with a piston which is movable in a cylinder wall, and with a spring to push the piston back or to pull it back.

It is an advantage to use a gas capsule 260 with a non-combustible gas such as $CO_2$, because as a result the risk of danger of explosion is strongly reduced, especially when the actuator is used to clamp pieces which, for example, need to be welded.

As shown in FIG. 3, an outlet 261 of the gas capsule 260 is connected with an inlet 271 of the pressure reducer 270, and an outlet 273 of the pressure reducer 270 is connected with an inlet 281 of the control valve 280, and a first outlet 284 of the control valve 280 is connected with an inlet 291 of the pneumatic cylinder 290. The piston or an extension 293 of the piston protrudes at the top of FIG. 3. On this protruding portion 293, optionally a small cap 294 can be provided.

The control valve 280 further comprises a second outlet 285 to the environment, and at least one control pin 282 for determining the mode of operation. The control valve can be a 3/2 valve. Dependent on the specific implementation, the control valve 280 may optionally comprise a second control pin 283, but that is not strictly necessary. In this case, the first control pin 282 is herein also referred to as "activation button", and the second control pin 283 is herein also referred to as "deactivation button" or "relaxation button".

The pneumatic actuator 240 may be attached to an arm of the screw clamp 200, e.g. to the movable arm 230 of a screw clamp, where the protruding portion 293 can extend in the space between the first and the second arm (see also FIG. 2).

Figure 4:
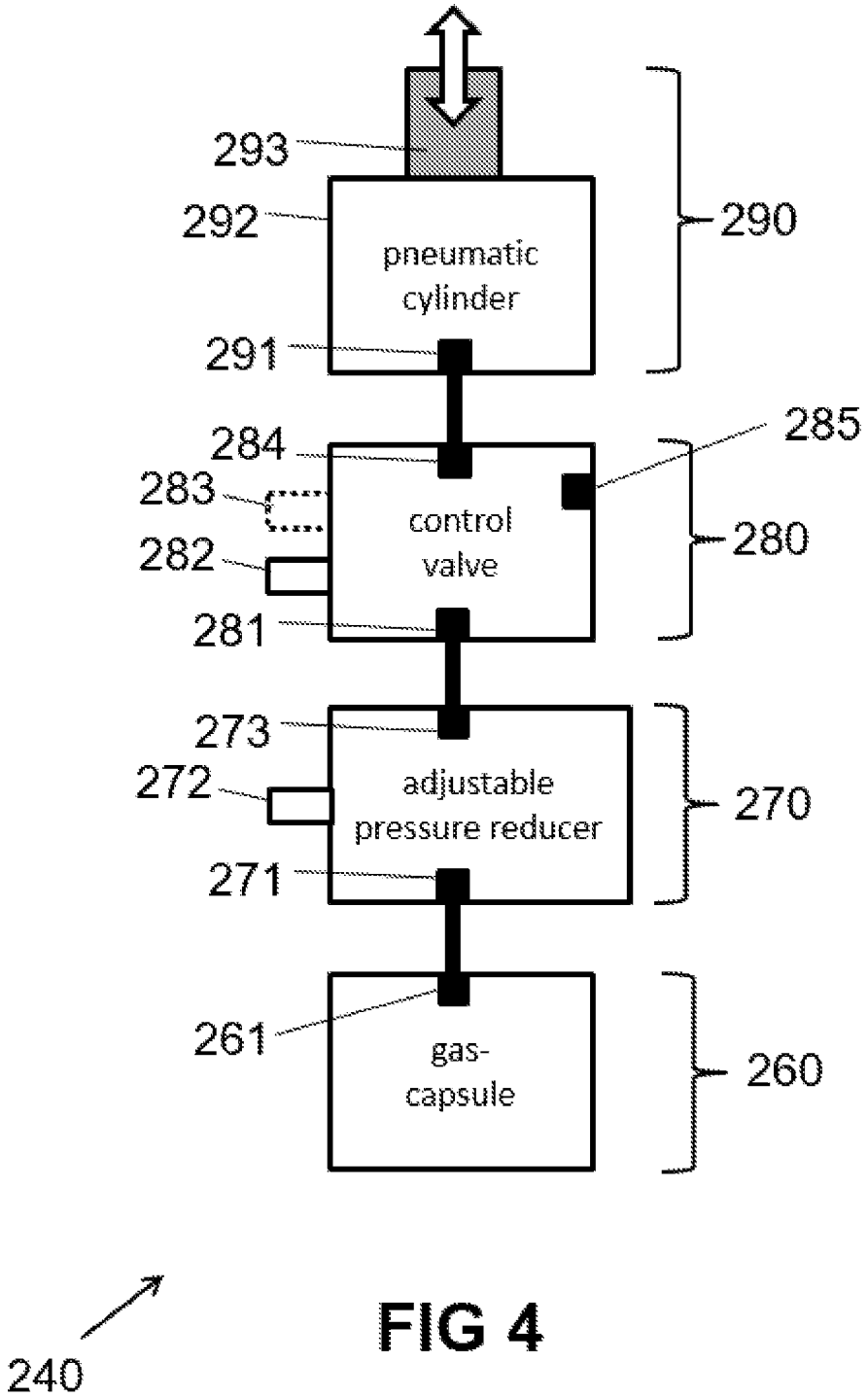
FIG. 4 shows a schematic block diagram of a preferred embodiment of a pneumatic actuator according to the present invention, having an adjustable pressure reducer.

FIG. 4 shows a schematic representation of a preferred embodiment of a pneumatic actuator 240 according to the present invention. This can be seen as a special embodiment of the pneumatic actuator according to FIG. 3, where the pressure controller is adjustable, and further comprises a setting member 272, e.g. an adjustment knob in the form of a turning knob, but the invention is not limited hereto and other setting members can also be used.

The difference between the schematic drawing of FIG. 3 and FIG. 4 may seem small, but in practice the presence of an adjustable pressure reducer 270 makes a vast difference, on the one hand because, as a result, the clamping force is adjustable (in contrast to the first prototype 100, 140 where the clamping force was fixed), and on the other hand because, as a result, the number of activations for a given type of gas capsule can be dramatically increased.

As far as known to the inventors, no pressure reduction component, intended to deliver discrete amounts of gas supplied at a relatively high pressure of, for example, 20 to 32 bar to an adjustable lower pressure of, for example, 2 to 10 bar, is available. And if such a component does exist, it is questionable whether it meets the requirements of the present invention, in particular in terms of dimensions (compactness) and weight.

Moreover, with the second prototype, the inventors have attempted not only to make the adjustable pressure reducer 270 as compact as possible, but to make the combination of the adjustable pressure reducer 270 and the control valve 280 together as compact as possible.

Further they have attempted to make the space of the channels between the various parts as small as possible, to make the number of activations per gas capsule as large as possible.

It is estimated that with the second prototype a $CO_2$ gas capsule having an air content of 60 grams under 32 bar, 100 to 150 activations can be carried out, if the reduced pressure is set to 2 bar, before the pressure in the capsule has decreased to 2 bar, and [the capsule] therefore becomes practically unusable. To achieve this, the component was made compact to such an extent that the volume of gas needed per activation (except the first time after a new gas capsule is mounted) is less than 0.025 litre=25 ml, preferably less than 20 ml, with more preference less than 15 ml, e.g. about equal to 13.5 ml. This was a major challenge.

But the invention is not limited to gas capsules with 60 grams of $CO_2$ under 32 bar, and other gas capsules, e.g. gas capsules with a content higher or lower than 60 grams (e.g. 88 grams) and/or gas capsules with a higher or lower pressure than 32 bar can also be used. Such gas capsules are commercially available and are typically used for pumping up bicycle tyres.

The reader skilled in the art who is familiar with tightening a screw clamp in industrial applications (e.g. in the metal industry and/or building construction) will undoubtedly wonder whether a gas capsule can provide sufficient clamping force. This will be discussed with reference to some examples.

1) a pressure of 2.0 bar exerted upon on a circular surface having a diameter of 30 mm provides a force of about F≈141N.
2) a pressure of 10.0 bar exerted upon on a circular surface having a diameter of 40 mm provides a force of about F≈1256N.
3) a pressure of 20.0 bar exerted upon on a circular surface having a diameter of 50 mm provides a force of about F≈6162N.

These examples show that the clamping force for many applications, also industrial applications, is more than sufficient.

Table 1 gives the clamping force (in Newton) for a variety of diameters d1 of the piston ranging from 30 mm to 60 mm, and for a variety of reduced pressures (at the inlet of the piston) ranging from 2 bar to 20 bar.

TABLE 1

| | 2 bar | 5 bar | 10 bar | 15 bar | 20 bar |
|---|---|---|---|---|---|
| 30 mm | 141 | 353 | 707 | 1060 | 1413 |
| 35 mm | 192 | 481 | 962 | 1442 | 1923 |
| 40 mm | 251 | 628 | 1256 | 1884 | 2512 |
| 45 mm | 318 | 795 | 1590 | 2384 | 3179 |
| 50 mm | 393 | 981 | 1963 | 2944 | 3925 |
| 55 mm | 475 | 1187 | 2375 | 3562 | 4749 |
| 60 mm | 565 | 1413 | 2826 | 4239 | 5652 |

As can be understood from the table, the piston diameter d1 has an important influence on the clamping force which can be exerted. In preferred embodiments for application in a screw clamp, the piston diameter d1 is a diameter in the range from 30 to 50 mm, e.g. in the range from 35 to 45 mm, e.g. equal to about 40 mm, because this offers an optimal compromise between sufficiently large to supply sufficient force, and sufficiently small due to compactness and ease of handling (ergonomics), but the invention is not limited hereto and other dimensions are also possible.

In all prototypes, the pneumatic actuator 140, 240, 340 has a substantially constant outer diameter over its whole length, or about 60 mm for the first prototype 140, and about 50 mm for the second and third prototype 240, 340, but the invention is not limited hereto, and it is, for example, also possible to use a pneumatic cylinder 290 having a diameter which is larger than the diameter of the control valve 280 for applications where a larger pressure force is needed, as for example a jack to raise an automobile or another vehicle if it has a flat tyre.

FIG. 3 and FIG. 4 are not only valid for the second embodiment, but for all embodiments of the present invention.

Figure 5:
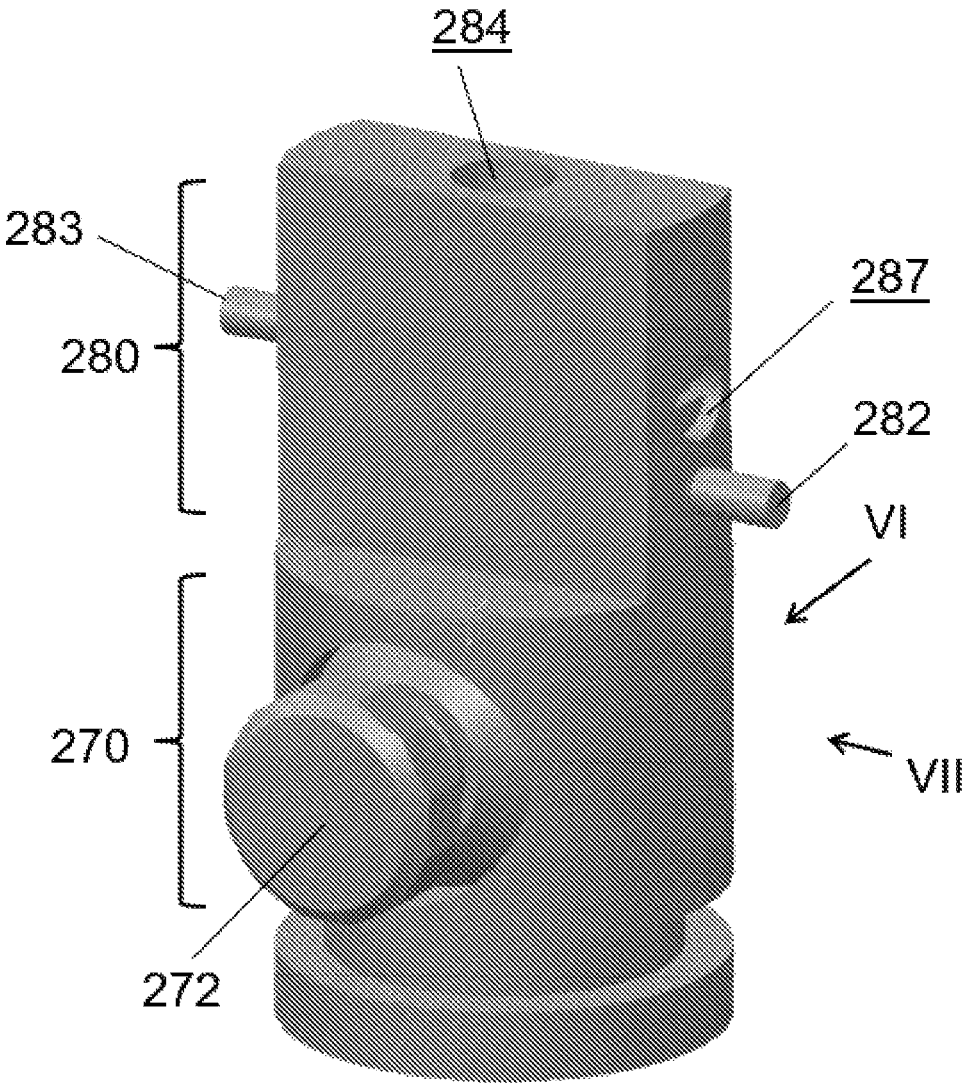
FIG. 5 to FIG. 9 show the internal structure of the second embodiment of a pneumatic actuator according to the present invention.

FIG. 5 shows a perspective view of a portion of a pneumatic actuator 240 according to the second embodiment of the present invention. The portion shown comprises an adjustable pressure reducer 270 as well as a control valve 280, implemented as a single body, preferably made of plastic, e.g. polyethylene.

In this embodiment, the control valve 280 has a first control pin 282 to activate the piston (which is connected with the outlet 284, but is not shown in FIG. 5), and a second control pin 283 to deactivate the piston. By turning the button 272, the desired pressure to be exerted on the piston can be set.

In a variant (not shown), the adjustment knob 272 may comprise a lever, and/or the adjustment knob 272 may comprise an internal recess for inserting a socket wrench or the like. In this way, a larger torque can be exerted on the adjustment knob 272.

Figure 6:
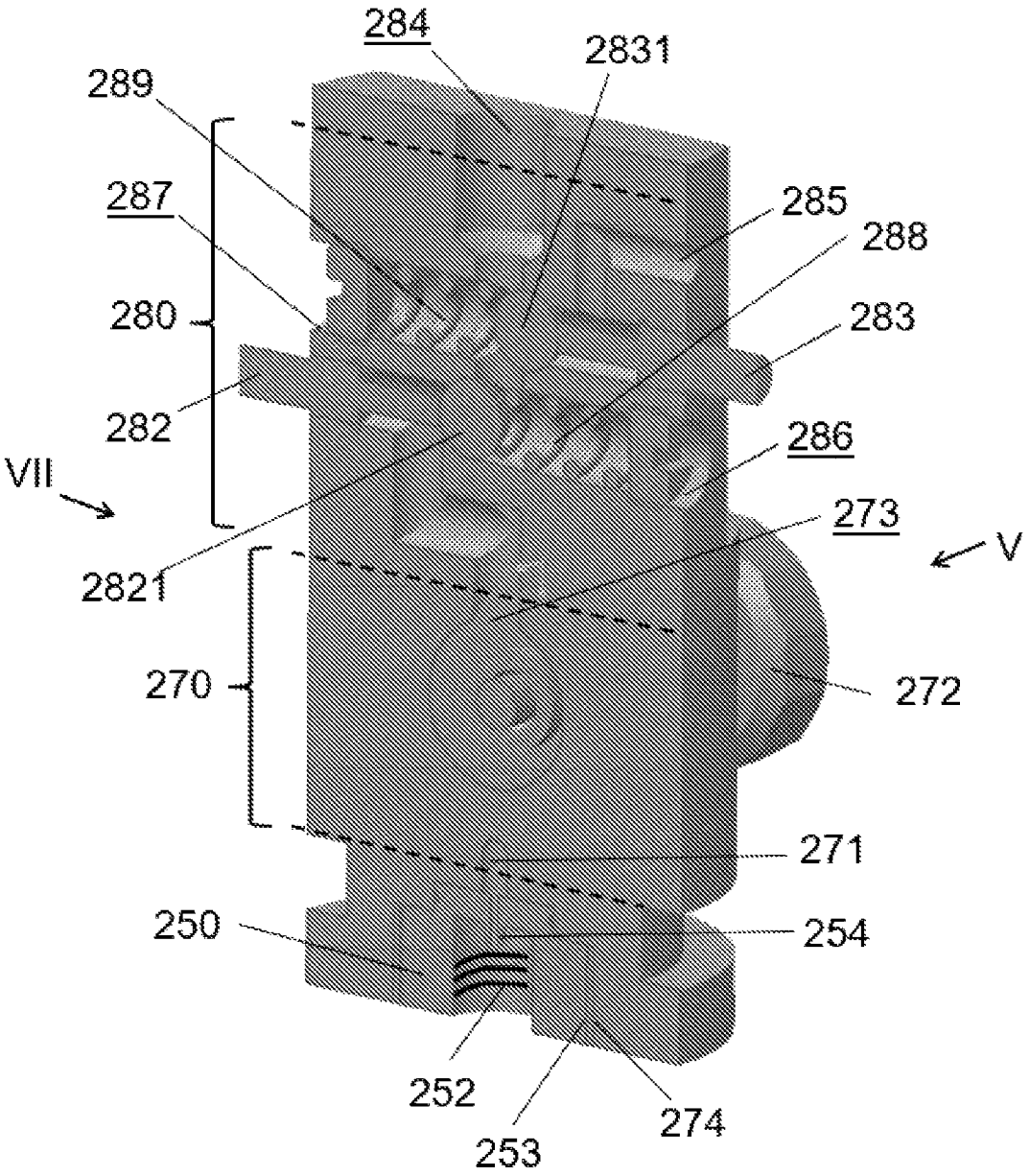

FIG. 6 shows the portion of FIG. 5 in cross-section, when viewed from another viewpoint. The following parts can be distinguished:

At the bottom of FIG. 6 a transition element (adapter) 250 is visible which is preferably made of steel, for example a hardened steel, for example a nitrided steel, for example a nitrided steel having a hardness of at least 55 HRC (Rockwell C hardness), for example with about 60 HRC. In a specific embodiment, nitride steel 1.8550 according to DIN 17211 is used, but the invention is not limited hereto.

The transition element 250 has an internal screw thread 252 configured for mounting a gas capsule with corresponding external screw thread. The transition element 250 has external screw thread 253 for attaching the transition element to the adjustable pressure reducer 270, by engagement in corresponding internal screw thread 274 of the body shown in FIG. 5. The transition element further has a puncture element 254 for puncturing a metal surface of the gas capsule (not shown in FIG. 6 but see FIG. 8 and FIG. 9, for example). Thanks to the threaded connection 252 between the transition element 250 and the gas capsule, an empty gas capsule can easily be replaced by another gas capsule by a user. Thanks to the threaded connection 253, 274, the transition element 250 can be replaced, for example in a specialised repair service, when the transition element 250 is worn. In this way, the lifetime of the pneumatic actuator 240 can be dramatically extended, and thus also the lifetime of the tool in which the actuator is optionally incorporated.

Figure 7:
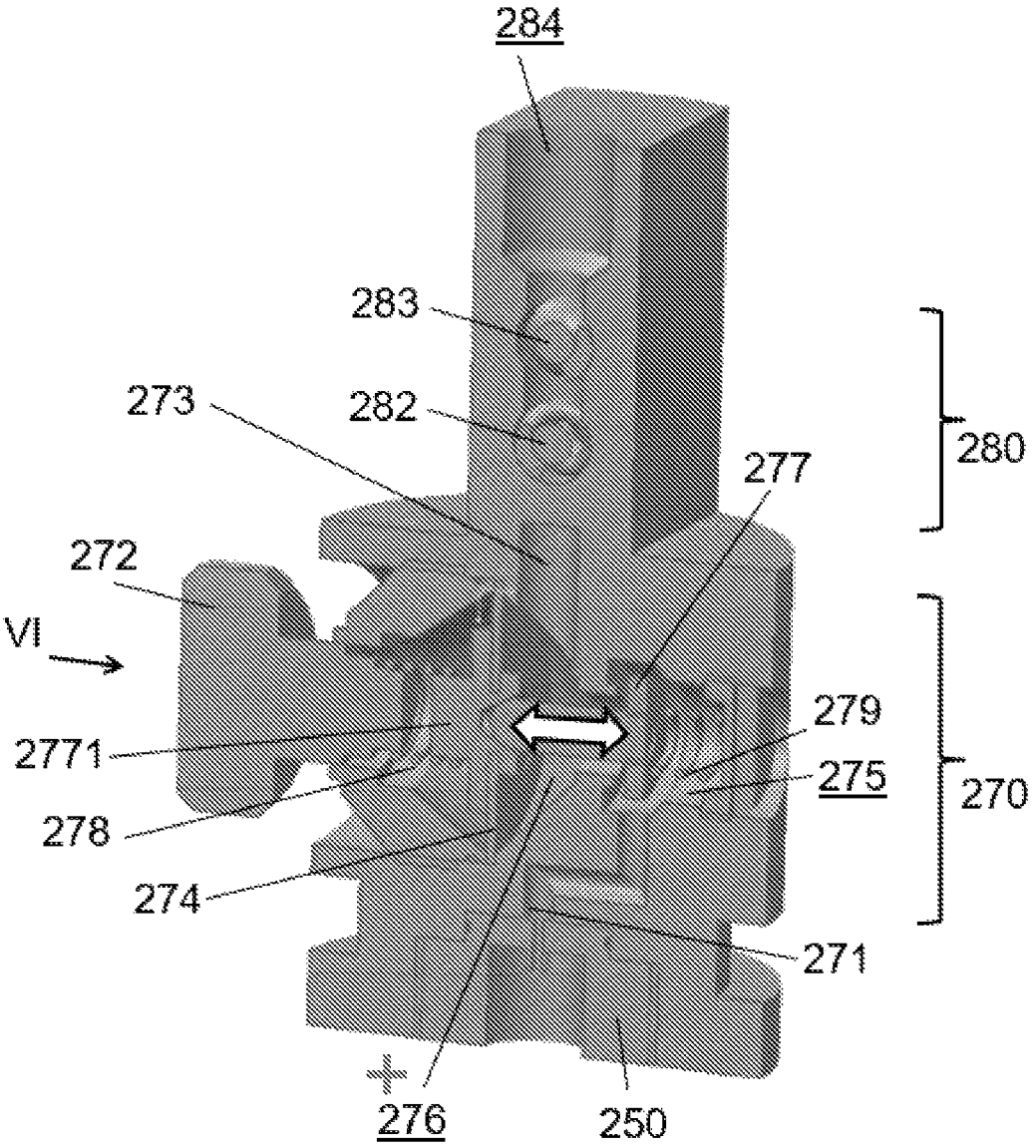

In the middle of FIG. 6 the adjustable pressure controller 270 is shown, but its operation can better be understood from FIG. 7.

At the top of FIG. 6, the control valve 280 is shown, with a first control pin 282 which, when pressed against the force of the spring 288, connects the outlet 273 of the pressure reducer 270 with the outlet 284 leading to the piston, preferably by means of a substantially straight line in order to prevent or reduce pressure loss.

In the particular embodiment shown in FIG. 6, a conical or a spherical object, for example a ball 2821, is used to shut off the channel (between the second chamber and the inlet of the piston), which ball 2821 is slid when the control pin 282 is depressed, but the use of a ball is not strictly necessary and other seals may also be used, for example a control pin with O-rings and having a variable diameter (not shown), or a piston push button as used in the third prototype. The latter can be made of stainless steel, for example, also referred to as RVS or inox.

The control valve 280 of FIG. 6 further comprises a second control pin 283 which, when pressed against the force of the spring 289, connects the outlet 284 to the piston with the second outlet 285, also referred to as outlet into the environment. The second control pin 283, like the first control pin, has an associated spring 289 and a ball 2831, but other sealings are also possible. The skilled person will understand that the ball 2821 and the spring 288 of the first control pin 282 can be inserted via opening 286 during production, the opening subsequently being air-tightly closed off, for example by screwing and/or by glueing and/or melting or in another appropriate manner. In a similar manner, the ball 2831 and the spring 289 of the second control pin 283 can be inserted during production via opening 287, the opening subsequently being air-tightly closed off, for example by screwing and/or glueing and/or melting or the like.

FIG. 7 shows the portion of FIG. 5 in another cross-section, through the adjustment knob 272. From this figure, the operation of the pressure control 270 can be understood.

Gas enters from the gas capsule via the inlet 271 and flows into a first compartment 275 (also called first chamber) which thereby comes under high pressure, for example 32 bar. The first compartment 275 is in fluid communication with a second compartment 276 (also called second chamber) via a passage between the two compartments, which passage can be closed by a valve 277. This valve 277 is connected with a membrane 274 constituting a portion of the wall of the second compartment. The position of the valve 277 in the first compartment 275 is thus dependent on the position of the membrane 274 in the second compartment.

As shown, a spring 279 attempts to push the valve 277 to the left (towards the membrane) in order to close it, and a spring 278 attempts to push the membrane to the right (towards the valve) in order to open the valve. The spring 278 rests against an adjustment knob 272.

The operation is as follows: when the pressure in the second compartment 276 is low (for example about 1 bar), then the membrane 274 is pushed to the right (in FIG. 7) by the spring 278, and the valve 277 is opened, whereby gas under high pressure (for example about 32 bar) from the first compartment 275, which is in connection with the gas capsule, can flow into the second compartment 276. As a result, the pressure in the second compartment 276 rises, and a pressure is exerted on the membrane 274 which moves the membrane 274 to the left (in FIG. 7), against the pressure force of the spring 278. When the pressure in the second compartment 276 reaches a set value, as set by the adjustment knob 272, the valve 277 closes. In this way, an amount of gas at a relatively low pressure (for example 2 bar or 5 bar or 10 bar) can thus be obtained from a gas capsule at relative high pressure (for example 32 bar).

Referring to the functionality of the whole actuator, the second compartment 276 actually functions as an intermediate chamber, and the pressure of the gas in the intermediate chamber is set by the adjustment knob 272. When the actuator is subsequently operated by depressing the control pin 282, then in first instance the gas from the intermediate chamber 276 is distributed to the inlet of the piston, whereby the pressure in the intermediate chamber decreases. The membrane then moves to the right (in FIG. 7), the valve 277 briefly opens, and the gas in the second compartment 276 is supplemented from the first compartment. The valve 277 closes by itself again when the set pressure is reached.

In the case that the control valve is a 3/2 valve, it is also possible to increase the pressure force slightly by turning the adjustment knob 272, even after the workpieces are clamped. In the embodiment of FIG. 7, the pressure force can also be slightly increased by turning the adjustment knob 272, provided the activation button 282 is subsequently depressed again.

In a variant of this embodiment (not shown), the membrane is clamped between two parts each having an annular surface, which parts are mutually connected by means of screw thread, and together constituting the membrane holder 2771. In this way, the membrane can be clamped in over a larger surface, and the risk of the membrane coming loose from the membrane holder is reduced or eliminated.

Figure 8:
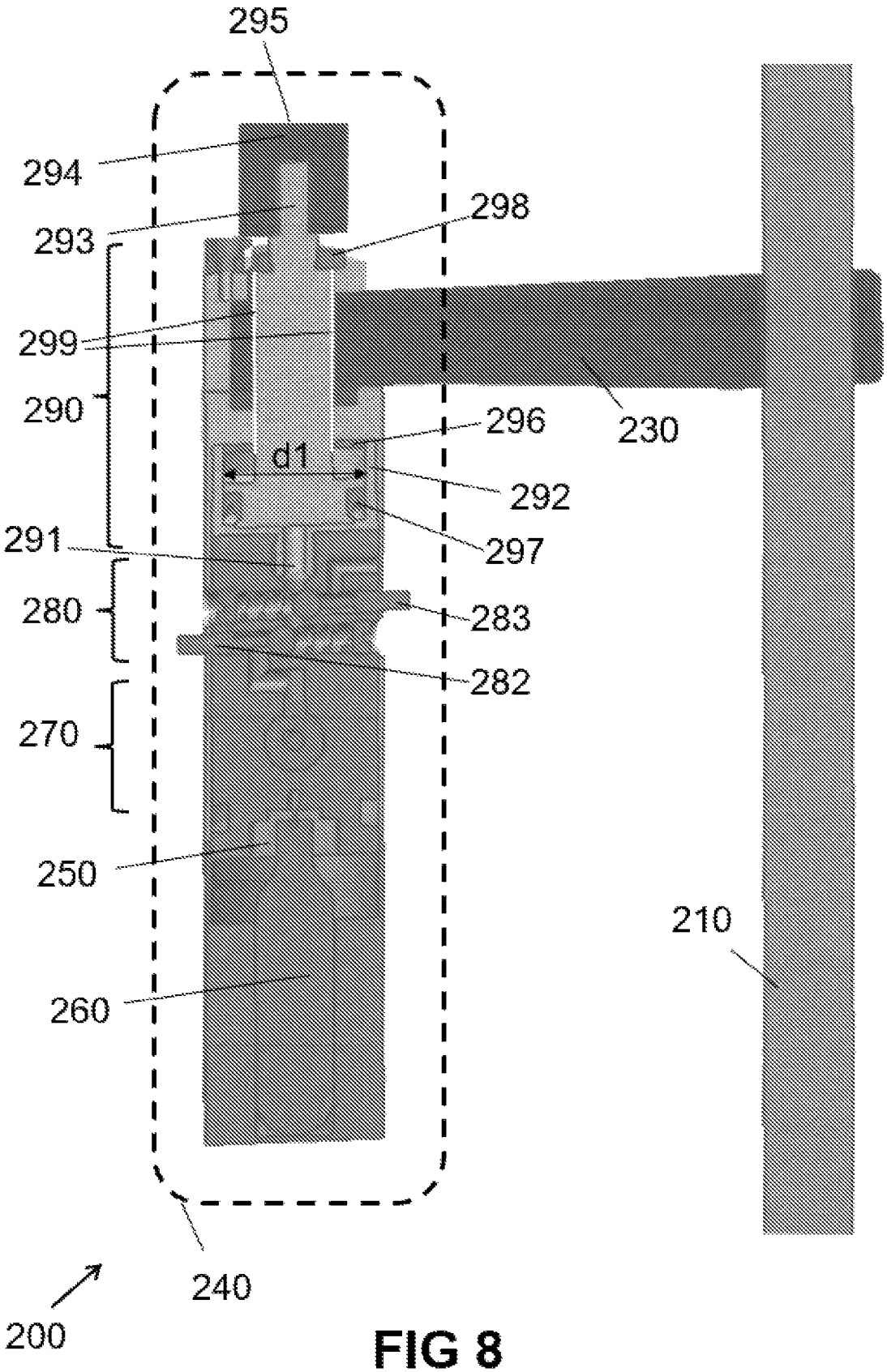

FIG. 8 shows a portion of the screw clamp of FIG. 2 in cross-section.

From this figure, the operation of the pneumatic cylinder 290 can be better understood. As explained above, upon depressing the first control pin 282, the pressure built up in the second compartment 276 will pass via the outlet 273 of the pressure reducer 270 and via the outlet 284 of the control valve to the inlet 291 of the piston 293, which under influence of the pressure will move outwards (upwards in FIG. 8). As a result the pressure in the second compartment 276 will decrease, the valve 277 will briefly open again until the set pressure in the second compartment 276 is reached again as described above, possibly several times until the piston 293 is fully extended.

When the piston 293 is fully extended, the pressure in the second chamber 276 no longer decreases, and the valve 277 will remain closed. The control pin 282 can be released, whereby the channel between the second compartment 276 and the piston inlet 291 is closed off to prevent leakage.

By depressing activation pin 282, the piston 293 has thus moved upwards in FIG. 8, whereby, in the event of a screw clamp, one or more workpieces can be clamped between the first arm 220 (not shown in FIG. 8 but see FIG. 2, for example) and the second arm 230 of the screw clamp 200.

Obviously the piston 293 is made to fit in the cylinder (for example with tolerance H7) and provided with the necessary sealings (among which 297), so that as little gas as possible can escape unwanted. Such sealings are known per se in the art, and thus need not be explained in more detail.

In the event of a screw clamp, the stroke of the pneumatic cylinder of the pneumatic actuator is preferably chosen in the range from 3 mm to 15 mm, for example from 5 to 12 mm, for example equal to about 8 mm or equal to about 10 mm, but the invention is not limited hereto and another piston stroke can also be chosen. The shorter the piston stroke, the more often the actuator can be operated (for a given gas capsule and a given set pressure force).

In a preferred embodiment the pneumatic cylinder 290 is a single-acting cylinder, with a spring to push the piston 293 back or to pull it back (dependent on how the spring is disposed). In the second embodiment, the spring is a cup spring 296 (in the figure displayed as a flat disc), but that is not necessary, and a classical spring can also be used (as will be further explained, see FIG. 15*a* or FIG. 18*a*, for example). The spring 296 ensures that the piston 293 is spontaneously pushed back inwards, after the user has operated the second control pin 283, whereby the pressure at the inlet 291 of the piston 293 is lost. It is an advantage to use a cup spring 296, because this contributes to a large extent to the compactness of the solution. Functionally, the cup spring ensures that the screw clamp releases easily, whereby it can be avoided that the user would need to strike against the second arm 230 with a hammer or the like to release the screw clamp after clamping. There is no pneumatic cylinder known to have a cup spring. The unique combination of the short piston stroke and the compact space makes a cup spring a unique and ideal solution, but the invention is not limited hereto.

FIG. 8 further shows a safety bolt 298 which can be turned in two positions, namely in a locked position and in an unlocked position. In the locked position, the safety bolt 298 has to ensure that the piston can not move outwards, even if a user were to accidentally activate the first control pin 282. In this way, accidents can be avoided.

FIG. 8 further shows that a top unit 294 can be provided on the piston 293, or on an extension thereof, for example by screwing. This top unit 294 can, for example, be made of polyethylene, for example hard polyethylene, and may be attached to the piston (or its extension) by means of screw thread, for example. By making use of an top unit 294 of polyethylene, scratches can be prevented when painted or lacquered objects, for example, need to be clamped. The top unit 294 preferably has a flat surface 295 for clamping objects, but the invention is not limited thereto and other top units are also possible.

In the embodiment of FIG. 8, the extension of the piston or the piston end portion is cylindrically-shaped, but the invention is not limited hereto, and other forms are also possible. In some embodiments, this extension or end portion is spherical, and the top unit 294 which engages with this spherical end portion is somewhat tiltable or rotatable. This has the advantage that also workpieces can be clamped of which opposite surfaces are not perfectly parallel.

FIG. 8 further shows how the pneumatic actuator 240 according to the present invention can be attached to the movable arm 230 of a screw clamp 200. But this aspect is better visible in FIG. 9.

Figure 9:
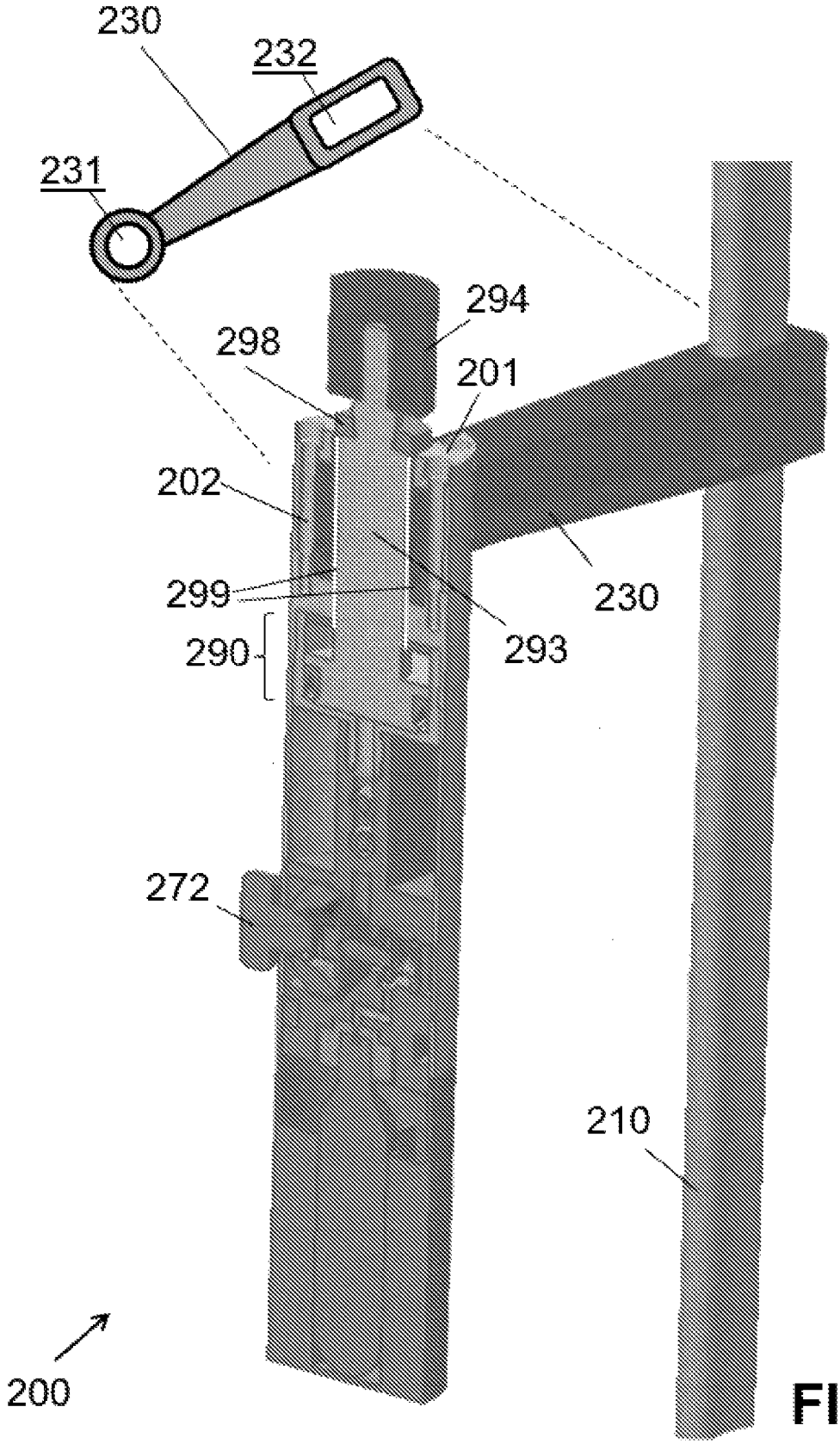

FIG. 9 shows a portion of the screw clamp 200 of FIG. 2 in cross-section.

At the top of FIG. 9, a second arm 230 is displayed with two through-openings 231 and 232. The piston 293 or an extension thereof is provided through the first opening 231, after which the second arm 230 is fixed to the actuator 240, for example by clamping it between two parts of the actuator 240, in the example of FIG. 9, using a ring 201 and a plurality of bolts 202.

As shown, sufficient clearance 299 is provided so that the piston 293 can pass through the opening 231 without touching the second arm 230. Through the second for example rectangular or oval opening 232 of the second arm 230, as common practice, the guide profile 210 is provided. Note that the piston 293 extends far beyond the cylinder 290, which preferably can be very small (for example less than 15 mm high) due to the short stroke.

During normal use, the user sets a desired pressure force by turning the adjustment knob 272, and needs to position the screw clamp appropriately, and needs to move the second arm 230 to against or substantially against the workpieces to be clamped, and needs to subsequently depress the control pin 282, after which the piston 293 will suddenly move and push against the workpieces with the set force.

FIG. 10 to FIG. 20 show a third embodiment of a pneumatic actuator 340 according to the present invention, incorporated in a screw clamp 300 according to the present invention, but, as already mentioned above, the actuator may also be incorporated in other tools.

The pneumatic actuator 340 according to the third embodiment can be seen as a variant of the actuator 240 according to the second embodiment, with as main differences: (1) an ordinary spring 3933 instead of a cup spring 296 to move the piston 393 back to the retracted position, (2) the first push button 382 does not shift a ball or a spherical object 2821, but has a first collar 3821 for forming a first valve 3821, and (3), the second push button 383 does not shift a second spherical object 2831, but has a second collar 3831 for forming a second valve 3831. Apart from these differences, the operation for both actuators is substantially the same. The third embodiment will therefore be only briefly explained. Where possible, as many similar reference numbers as possible will be used (preceded by 3- instead of 2-).

FIG. 10 to FIG. 18 are shown as grayscale drawing as well as line drawing for illustrative purposes.

Figure 10B:
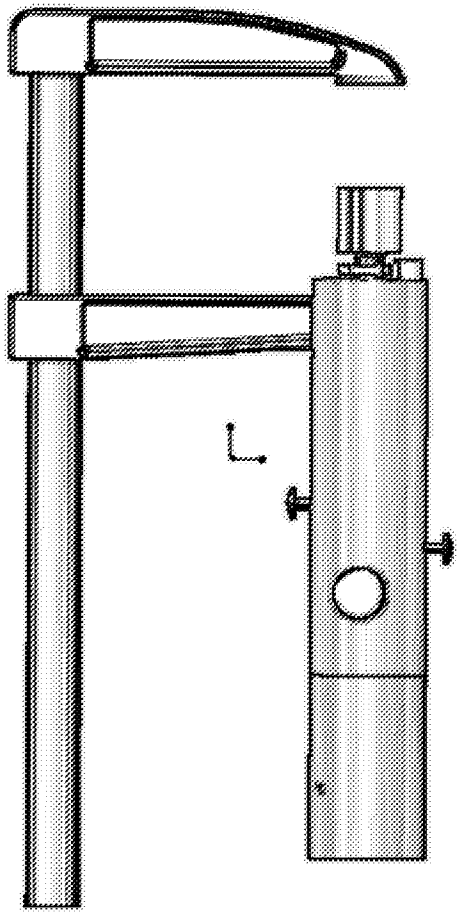
FIG. 10 to FIG. 20 show a third embodiment of a pneumatic actuator and a screw clamp containing the actuator, according to the present invention. This can be seen as a variant of the second embodiment of the pneumatic actuator and screw clamp.
Figure 10A:
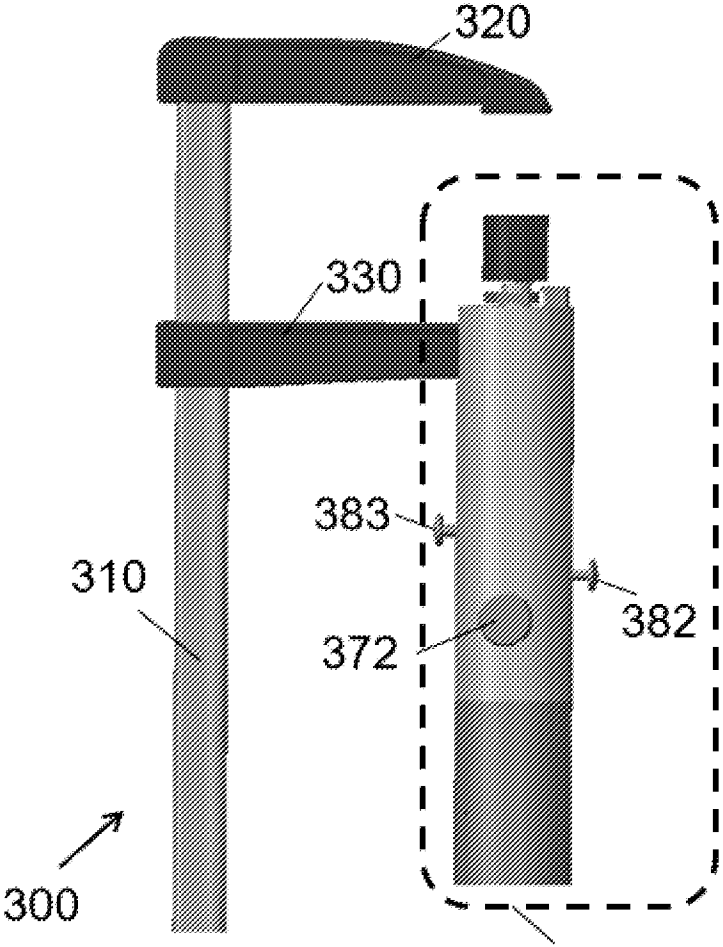

FIG. 10 shows a screw clamp 300 according to a third embodiment of the present invention. The screw clamp 300 comprises a pneumatic actuator 340 according to a third embodiment of the present invention. Except for the actuator 340, the screw clamp 300 of FIG. 10 is identical to the screw clamp 200 of FIG. 8 and FIG. 9, already described above.

FIG. 11 to FIG. 18 show various intermediate steps of a typical sequence or cycle of clamping and releasing the actuator 340 once. Each of these steps will now be explained in more detail.

Figure 11B:
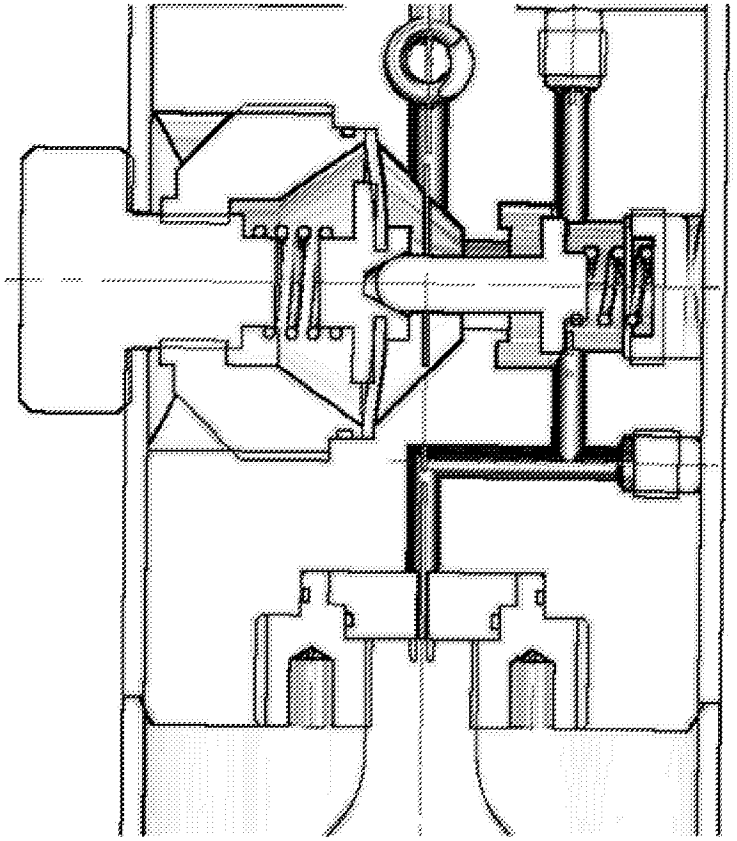
Figure 11A:
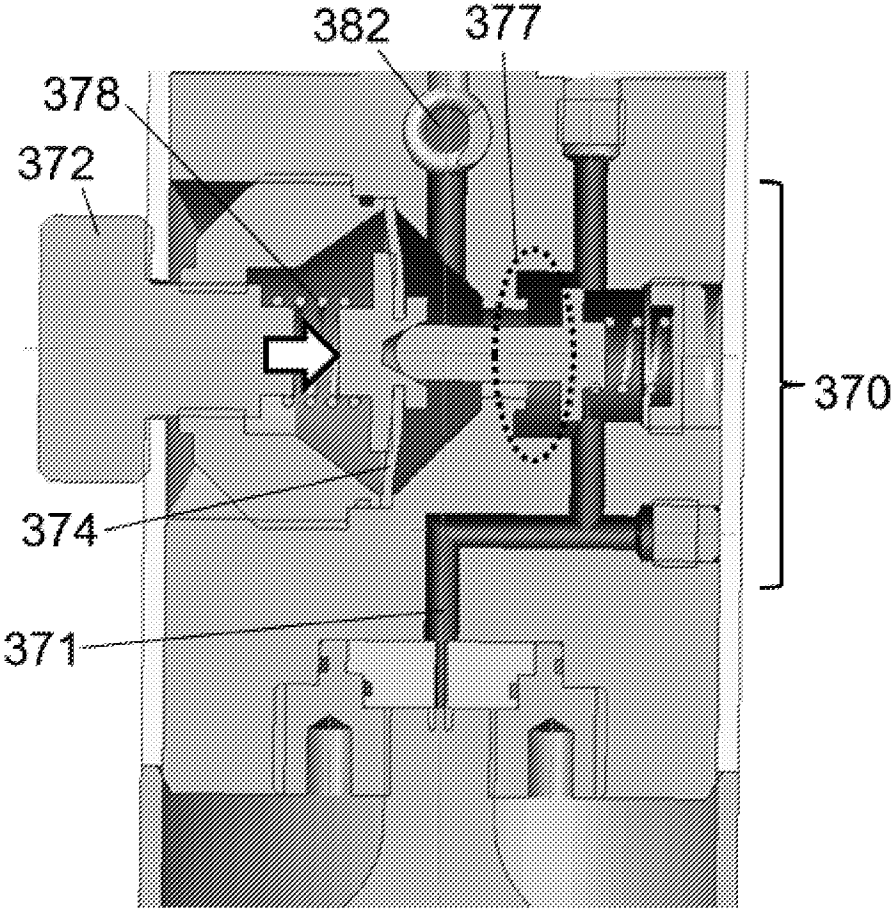

FIG. 11 shows the internal structure of the pneumatic actuator 340 of FIG. 10 in perspective cross-section, before a gas capsule is mounted. The inlet 371 of the pressure reducer 370 is connected with the environmental air (with a pressure of substantially 1 bar or substantially 10^5 Pa). The membrane 374 is pushed inwards (to the right in FIG. 11) by the spring 378 of the adjustment knob 372, for example turning knob. The shut-off valve 377 is open. By turning the adjustment knob 372, a desired pressure force can be set in advance. Even though not visible in FIG. 11, the piston 393 is in the fully retracted state (see FIG. 14).

Figure 12B:
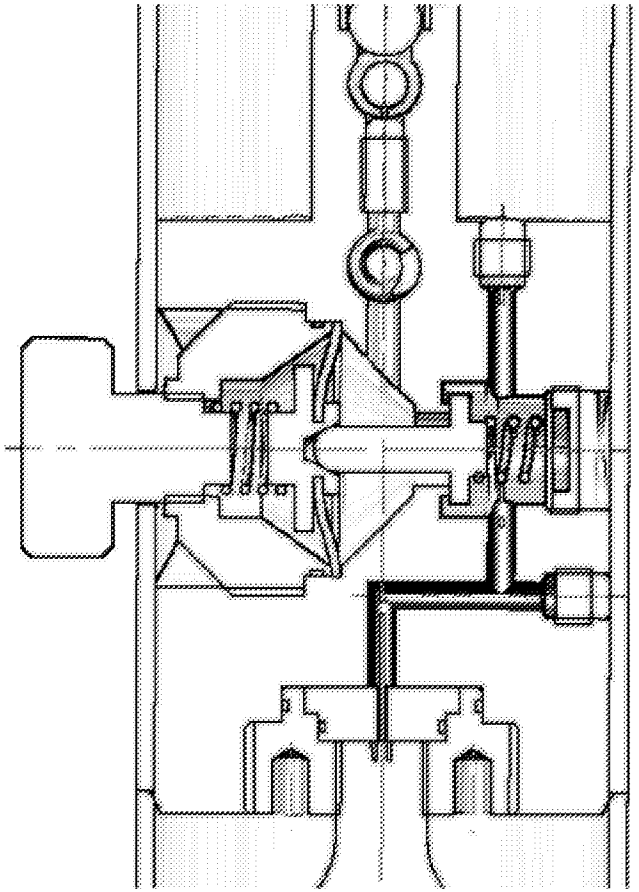
Figure 12A:
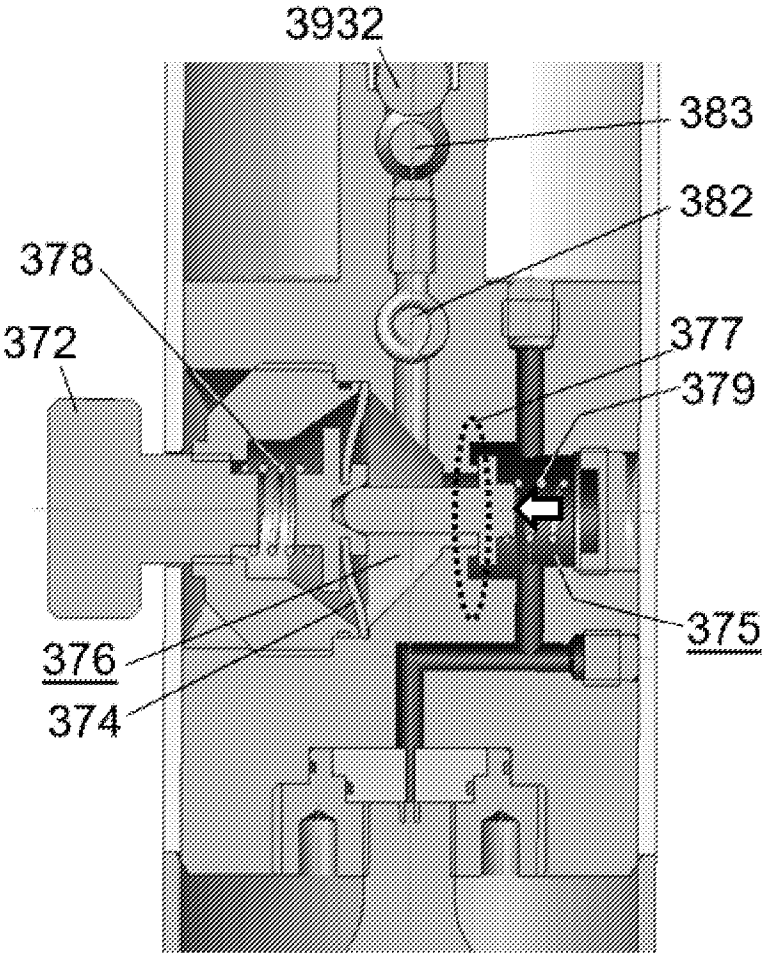

FIG. 12 shows what happens after the gas capsule is mounted (although the latter is not shown for illustrative purposes), assuming that the first and second push buttons 382, 383 are not depressed.

When gas under high pressure (for example 32 bar) enters the first chamber 375 and the second chamber 376, the pressure in the second chamber will rise, whereby the membrane 374 is pushed outwards (to the left in FIG. 12). When the pressure in the second chamber 376 reaches a pre-set value, the shut-off valve 377 is closed, as already described above.

In the third prototype, the amount of gas needed for this "initialisation step" is equal to about 0.004 litre=4 ml, and the amount of gas needed to use the actuator once (activation and deactivation) is equal to about 13.5 ml.

As long as the pressure in the second chamber 374 is greater than or equal to the pressure corresponding to the set pressure force, the shut-off valve 377 remains closed.

Figure 13B:
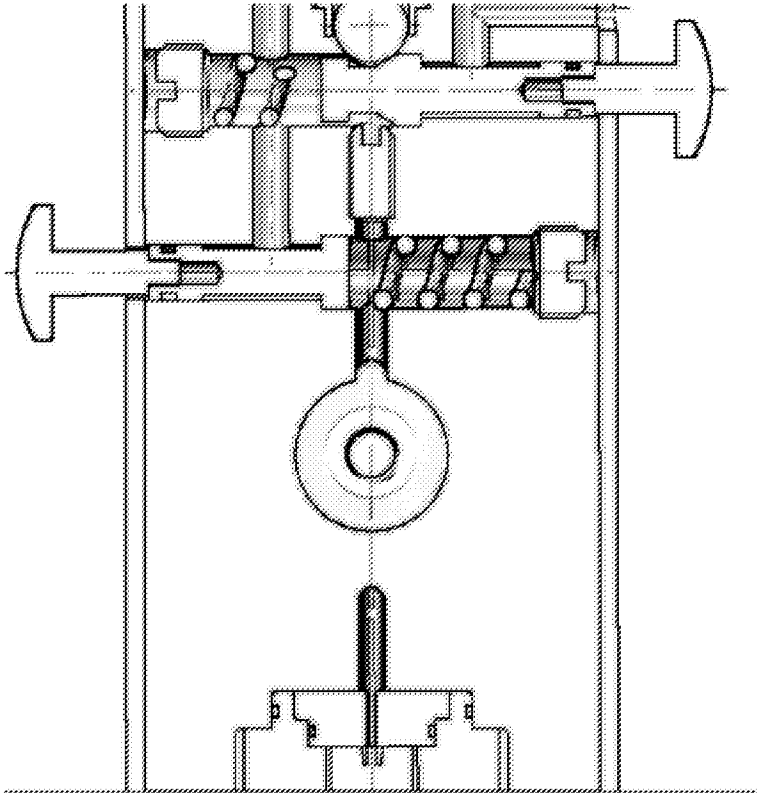
Figure 13A:
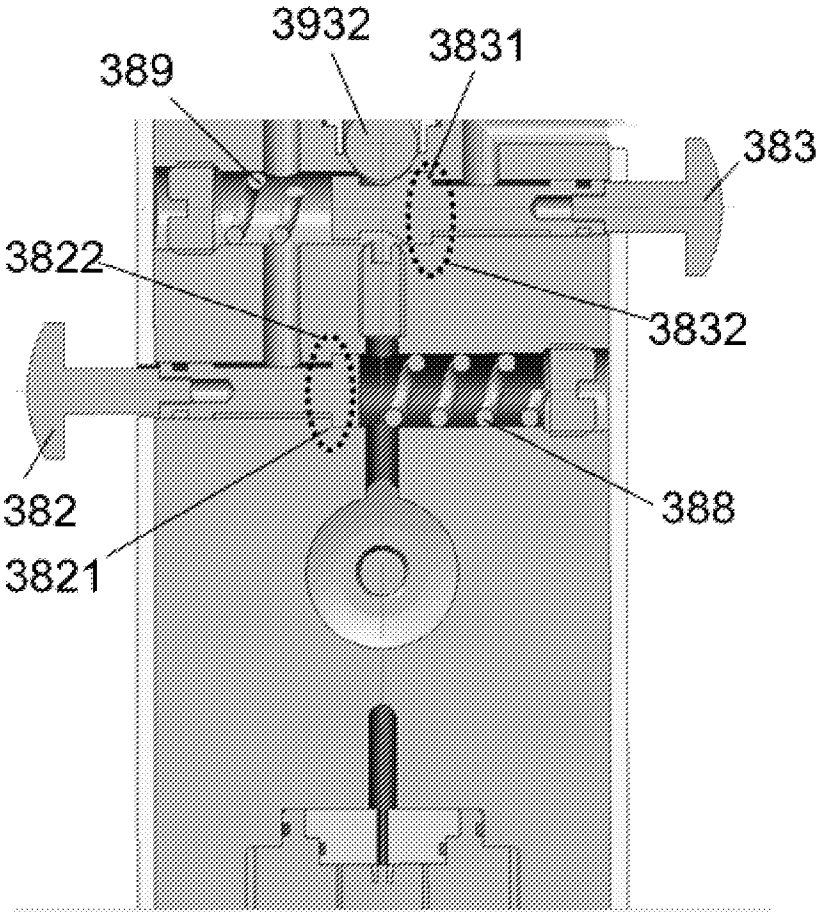

FIG. 13 shows the pneumatic actuator of FIG. 12, when viewed from another position. None of the push buttons 382, 383 are depressed. The second chamber 376 is in fluid connection with the space where the spring 388 is disposed, but not further, because the first push button 382, or more particularly a collar 3821 of the first push button 382, forms a first valve 3821, which is closed.

In the example of FIG. 13(*a*), the control pin 282 is composed of two parts: a part (for example of plastic) situated mainly externally, and an internal part (for example of metal or metal alloy, for example aluminium).

In a variant (not shown), the control pin 282 may be composed of three parts, for example an exterior element (for example of plastic, to avoid the part cooling down too strongly when the button is pressed); and a central element with axial grooves (to avoid the risk of buckling, and at the same time to promote the passage of gas); and an interior portion with a collar. To ensure good sealing in the pressure reducer 270, the interior portion can, for example, be made of a plastic material, for example teflon (also known as PTFE or polytetrafluoroethylene), or ertalon, or nylon or polyamides. Such plastic materials are quite strong, but still somewhat deformable, even at low temperatures as a result of gas which expands. In this way, the sealing can be further improved.

Figure 14B:
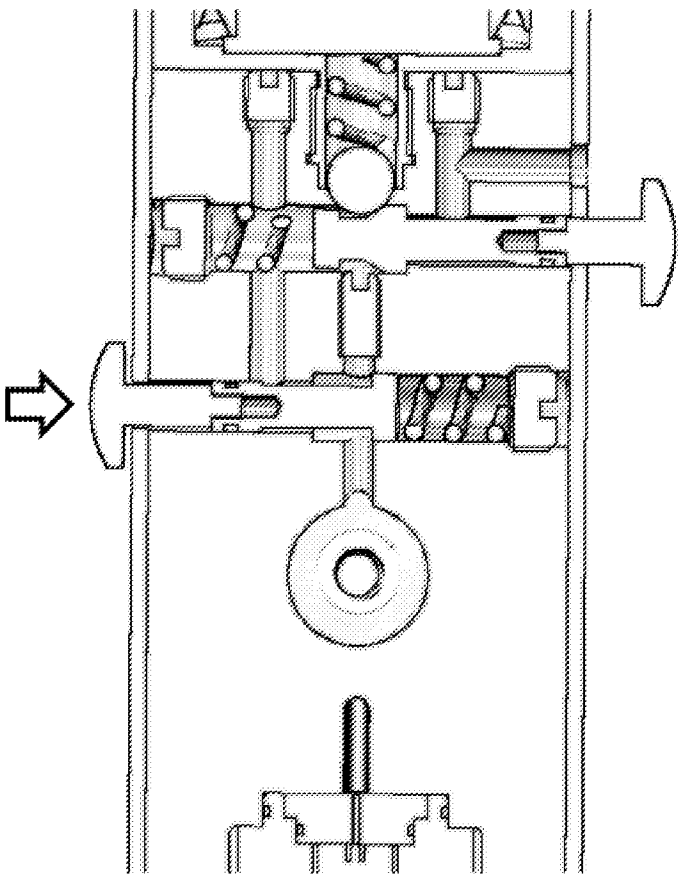
Figure 14A:
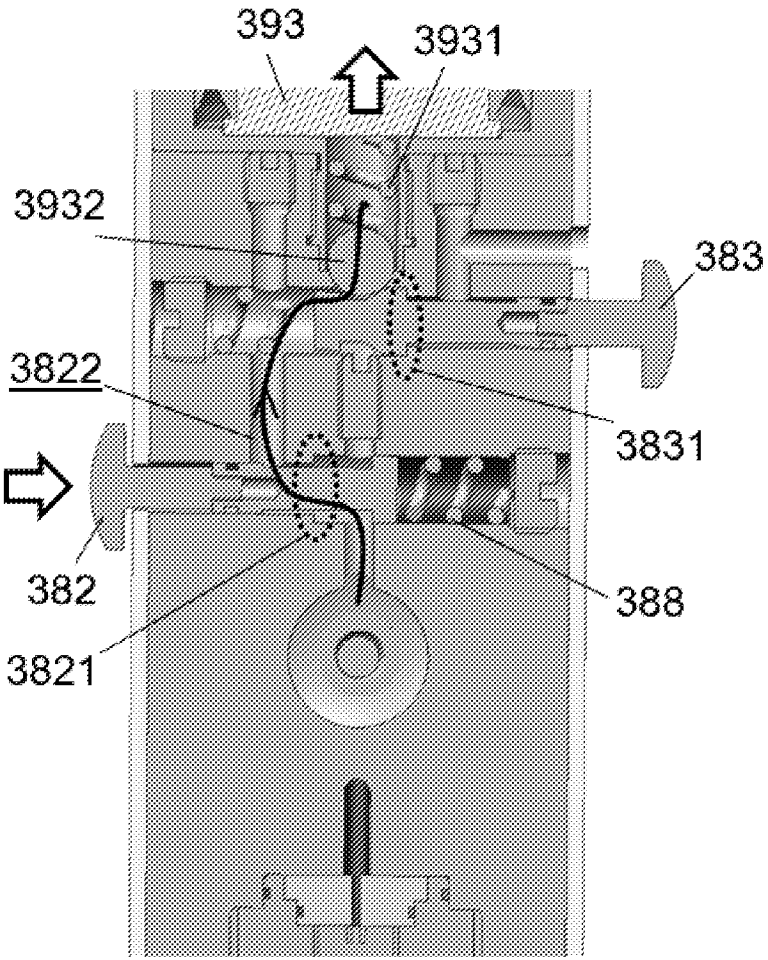

FIG. 14 shows the pneumatic actuator of FIG. 13 when the first push button 382 is depressed against the resilience of the spring 388. Hereby the first valve 3821 is opened, so that the gas can flow from the second chamber 376, along the extension of the first push button 382, through the connecting channel 3822, along the extension of the second push button 383 to the spherical object 3932, which will be pushed up under influence of the gas pressure against the force of the spring 3931, into the cylinder chamber, as designated by the arrow. The space in which the spring 3931 is located, being the cylinder chamber, thus comes under increased pressure, and the piston 393 is pushed outwards (upwards in FIG. 14). When the gas pressure in the second chamber drops to under a value corresponding to the position of the adjustment knob 372, the membrane 374 will move and temporarily open the valve 377 in an attempt to maintain the pressure in the second chamber 376, corresponding to the position of the adjustment knob 372.

Figure 15B:
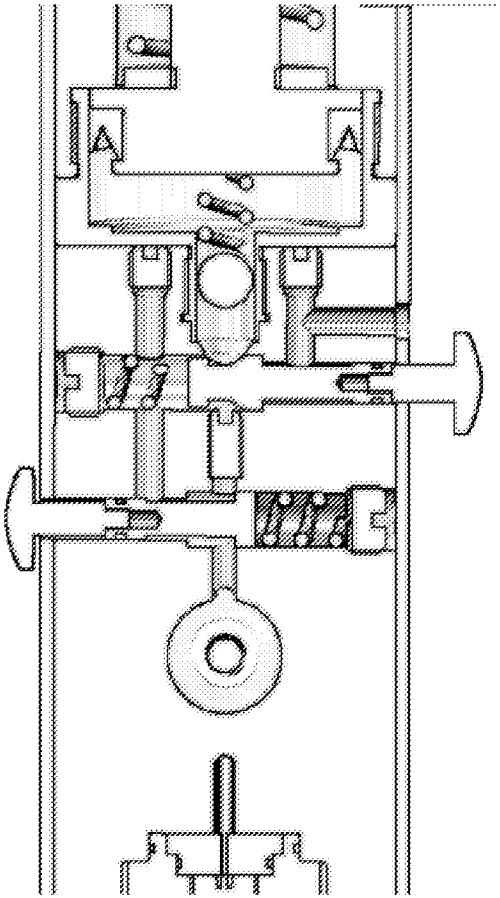
Figure 15A:
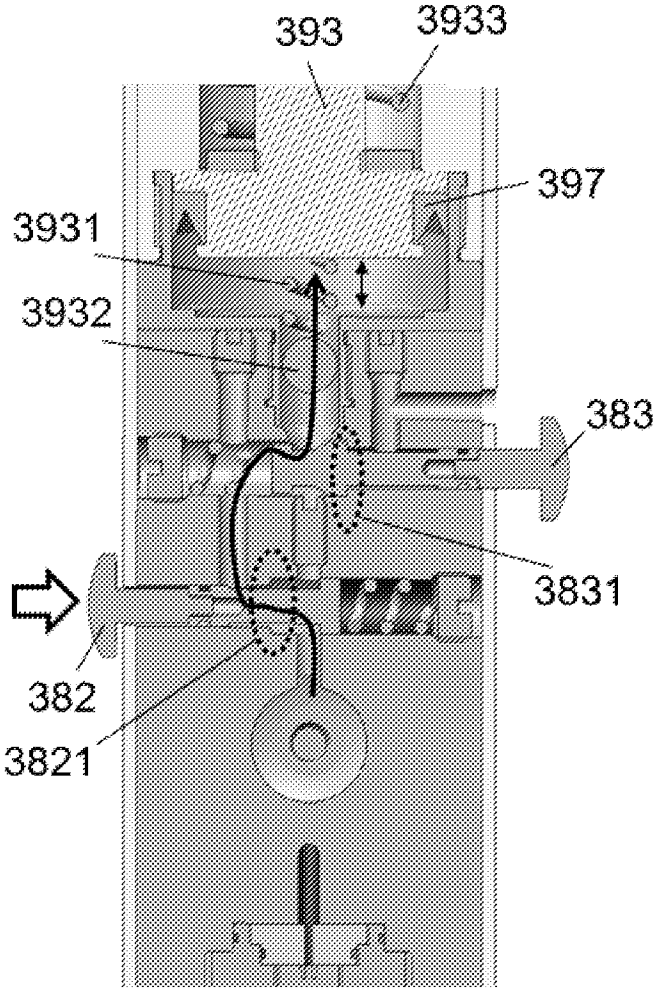

FIG. 15 shows the pneumatic actuator of FIG. 14 after the piston 393 is extended (upwards in FIG. 15), under influence of the gas pressure at the bottom in the cylinder chamber, against the force of the spring 3933. The spring 3931 pushes the spherical object 3932 down, and the cylinder chamber is closed off. The spring 3931 and the spherical object 3932 thus form a third valve which was automatically opened due to the increased pressure outside the cylinder chamber after depressing the activation button 382, and which is automatically closed under influence of the spring 3931 when the pressure in the cylinder chamber is substantially equal to the pressure in the second chamber 376.

Figure 16B:
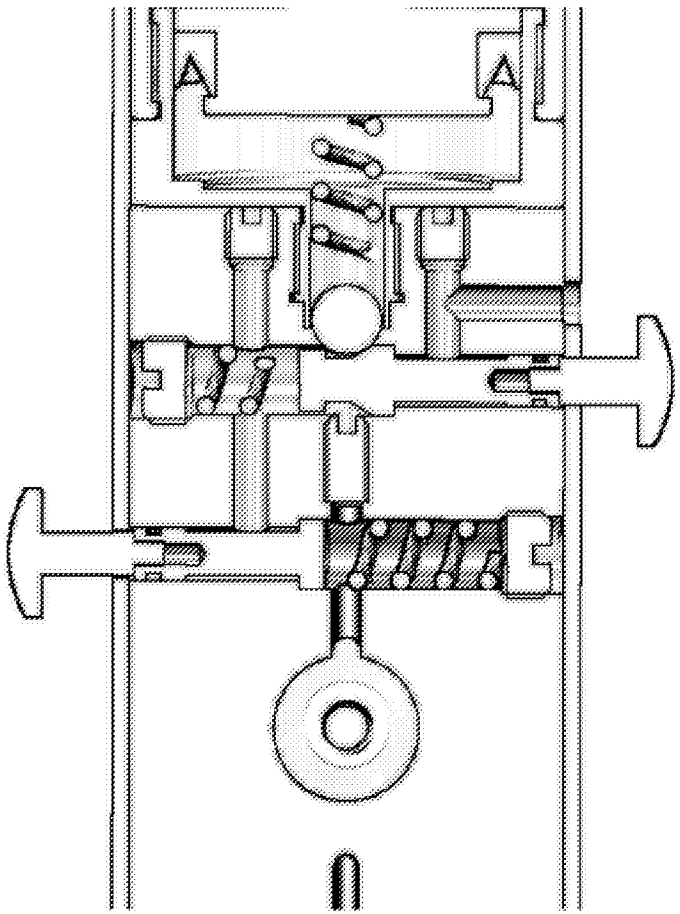
Figure 16A:
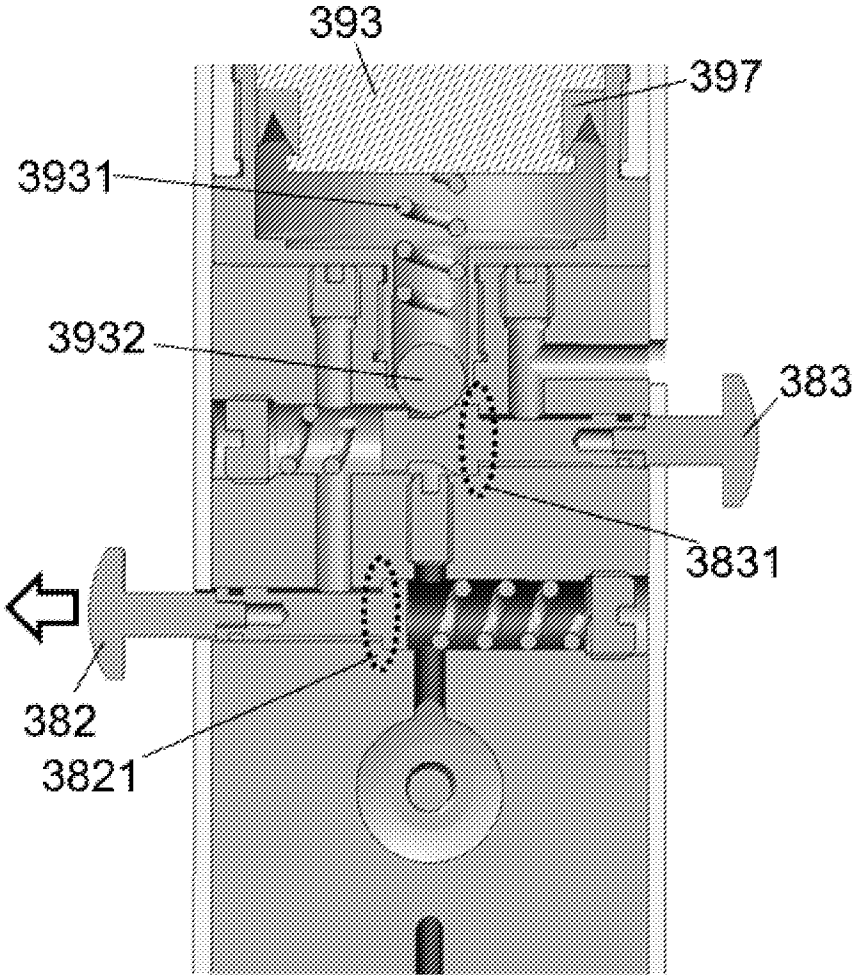

FIG. 16 shows the pneumatic actuator of FIG. 15 when the first push button 382 is released. The spherical object 3932 ensures that the pressure within the cylinder is maintained. The sealings 397 ensure that substantially no gas can escape, or at least that the leakage is limited as much as possible. When the piston 393 clamps workpieces, they will thus remain clamped.

Figure 17B:
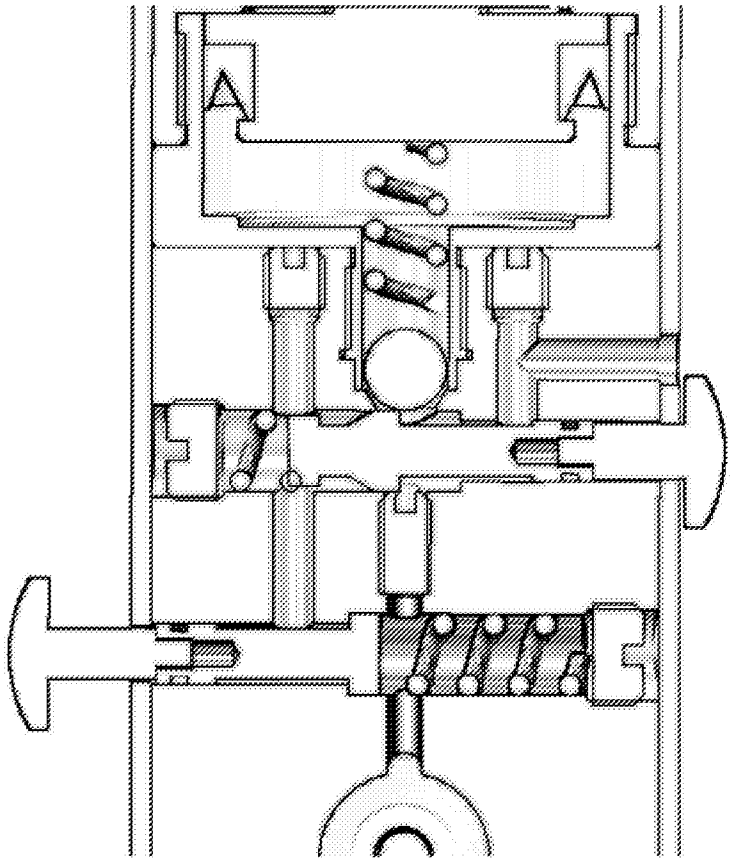
Figure 17A:
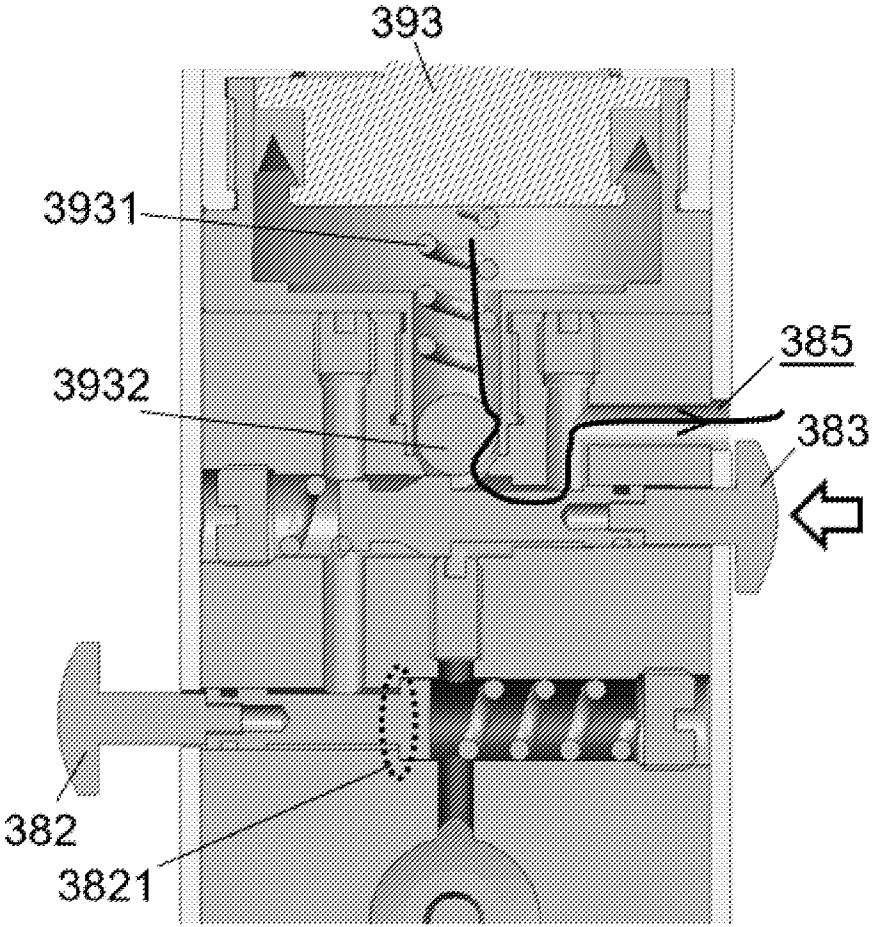

FIG. 17 shows the pneumatic actuator of FIG. 16 when the second push button 383, also referred to as relaxation button, is depressed. The extension of this push button 383 is implemented such that upon displacement thereof, the spherical object 3932 is pushed upwards, so that gas from the cylinder chamber can escape. Also the second collar is moved, whereby the second valve formed by this collar is opened, so that the gas which escapes from the cylinder chamber is discharged to the environment via the outlet 385. Under influence of a spring 3933 (see FIG. 18), the piston 393 will be pushed back inwards, after which the second push button 383 can be released.

Figure 18B:
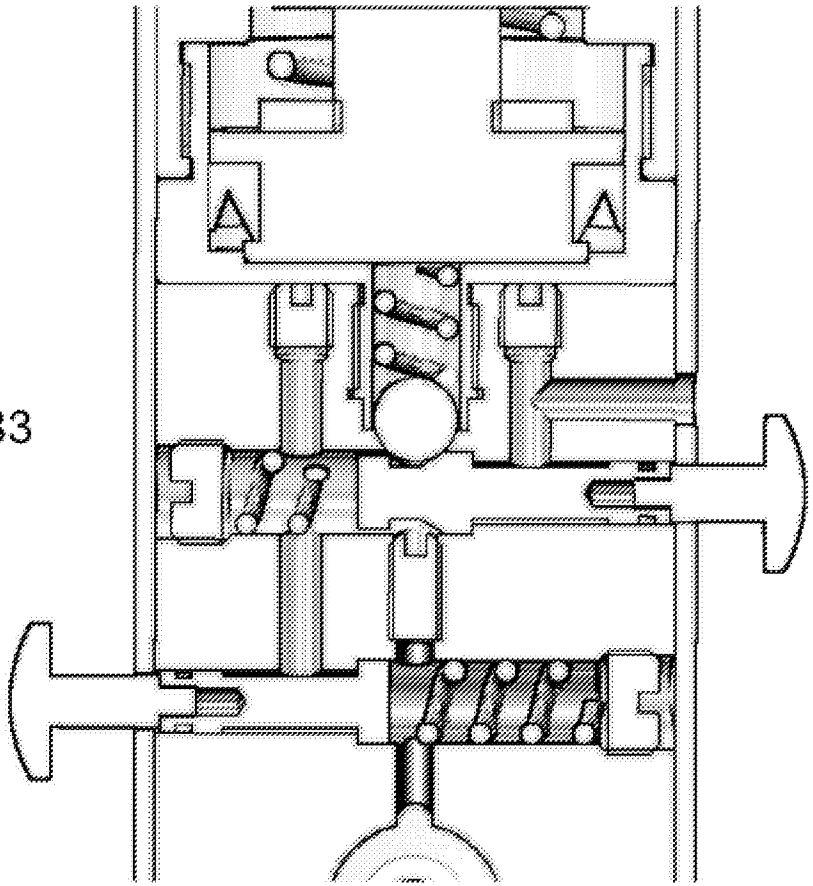
Figure 18A:
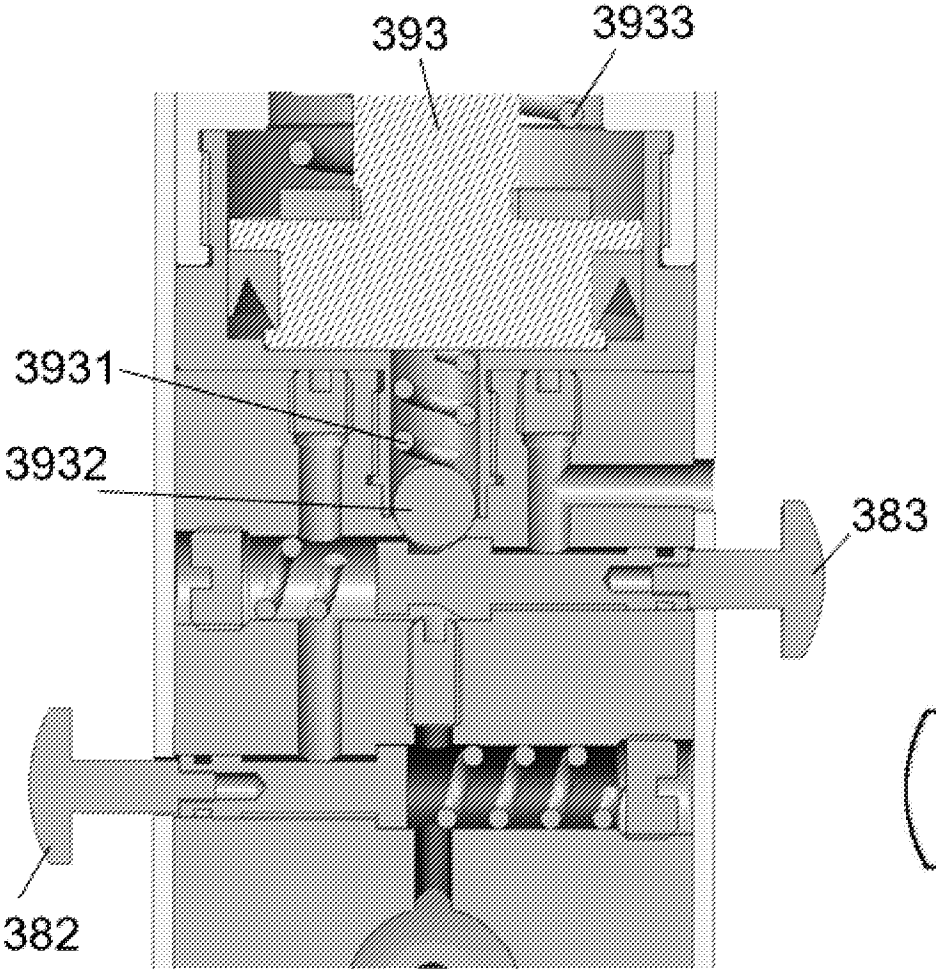

FIG. 18 shows the pneumatic actuator of FIG. 17 when the piston 393 is back in its fully retracted position, and the second push button 383 is released. This is the same state as shown in FIG. 13, differing in that the gas capsule contains one charge of gas less. It is estimated that a gas capsule with 60 grams of $CO_2$ under 32 bar contains sufficient gas for 100 to 150 activations and deactivations. This number is somewhat dependent on the set pressure force and on the actual piston stroke which the piston has to perform. When the pressure in the gas capsule has decreased too much, the gas capsule needs to be replaced.

Figure 19A:
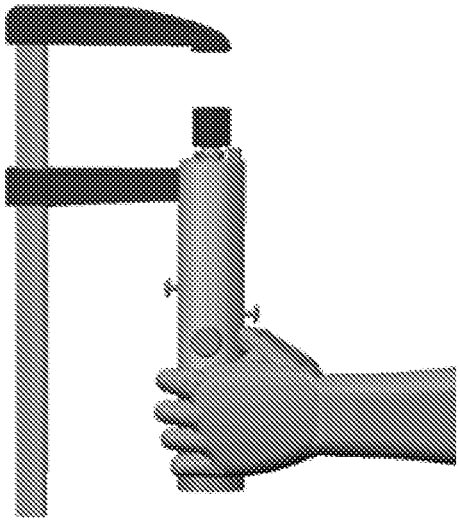
Figure 19B:
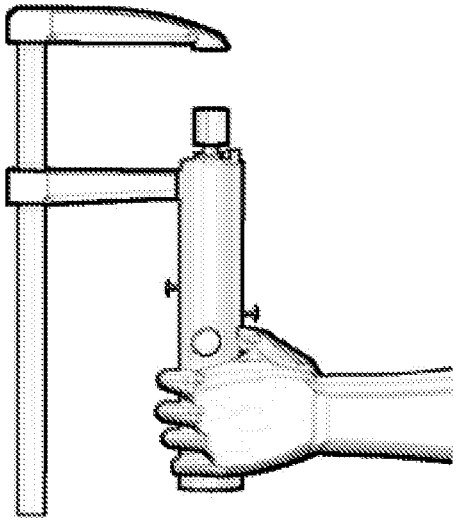

FIG. 19 shows an example of how the screw clamp 300 can be carried with one hand.

Figure 20A:
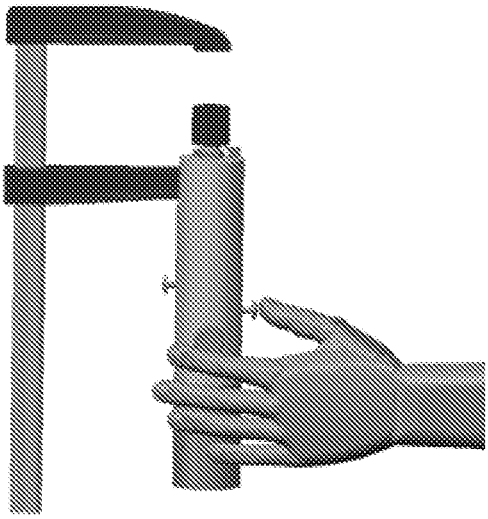
Figure 20B:
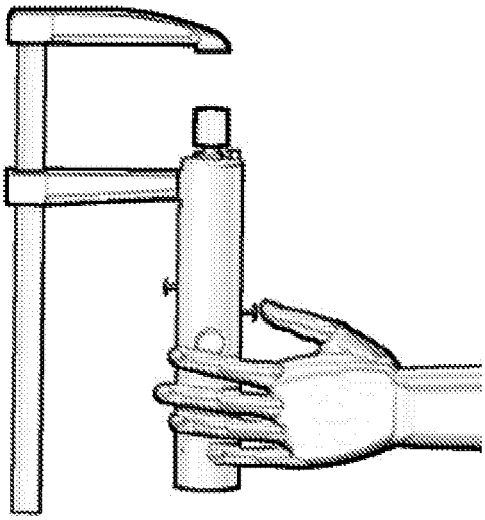

FIG. 20 shows an example of how the screw clamp 300 can be operated with one hand.

FINALLY,

- thanks to the choices of materials (for example polyethylene, aluminium piston and cylinder, aluminium casing) the effective end product is ergonomic, lightweight and strong.
- it is an advantage to use polyethylene for the pressure reducer and the control valve, because this is a strong material, and temperature-resistant (for example from −20° C. to +100° C.), and light weight.
- even though not explicitly shown in the figures, it is possible to apply an extra thermal insulation between the gas capsule and the aluminium casing 263. In this way, sudden strong cooling off of the aluminium after repeated use of the screw clamp is avoided. In this way, inconveniences and/or potential burn injuries can be avoided.

the pneumatic actuator according to the second prototype described above, with dimensions of 50 mm diameter and a length of about 22 cm, has a mass of about 600 grams, and a typical screw clamp containing this actuator has a mass of about 2.2 kg to about 2.5 kg. It is an advantage that this screw clamp can be operated overhead and can be fastened with one simple press of the button.

obviously the necessary steps have been taken to ensure that as little as possible gas can escape. For this purpose, among others, O-rings are provided at various places, the openings 286 and 287 along which the spherical object and the spring are inserted are preferably closed by welding or sealed by melting, the dimensions of the piston and the cylinder are matched to each other with a fitting seam (for example with tolerance H7), the piston is provided with the necessary sealings 297, for example sealing flaps, or the sealing is realised by a flat or conical plastic collar (for example teflon) which fits to a complementary aluminium part, etc.

preferably also an aluminium casing 262 is crimped around at least the pressure reducer and the control valve in order to further enhance the safety.

the prototype was constructed by 3D-printing, but the ultimate plastic body is preferably produced by injection moulding.

REFERENCES

100 first embodiment of screw clamp (first prototype)
140 first embodiment of pneumatic actuator (first prototype)
d2 outer diameter
160 gas capsule
182 control pin (both activation and deactivation)
184 vent hole
180 control valve
190 pneumatic cylinder (piston and cylinder)
200 second embodiment of screw clamp
201 ring
202 bolts
210, 310 guide profile
220, 320 first arm
221 first contact surface
230, 330 second arm
231 first opening
232 second opening
240 pneumatic actuator
250 transition element (adaptor)
254 puncture element
260 gas capsule
261 outlet of the gas capsule
262 first metal casing
263 second metal casing
270, 370 pressure reducer
271, 371 inlet of the pressure reducer (for example reducing valve)
272, 372 adjustment knob of the pressure reducer (for example reducing valve)
273 outlet of the pressure reducer (for example reducing valve)
274, 374 membrane
275, 375 first compartment
276, 376 second compartment
277, 377 shut-off valve
2771 membrane holder
278, 378 first spring
279, 379 second spring
280 control valve
281 inlet of the control valve
282, 382 first control pin of the control valve
2821 ball or spherical object of the first control pin
283, 383 second control pin of the control valve
2831 ball or spherical object of the second control pin
284 first outlet of the control valve
285 second outlet of the control valve
286 first mounting opening
287 second mounting opening
288 spring of the first control pin
289 spring of the second control pin
290 pneumatic cylinder (piston and cylinder)
291 inlet of the pneumatic cylinder
292 cylinder (wall) of the pneumatic cylinder
293, 393 piston of the pneumatic cylinder, or an extension thereof
3821 collar of the first control pin
3822 connection channel
3831 collar of the second control pin
3931 spring for the spherical object of the piston
3932 spherical object at the inlet of the piston
3933 spring to push the piston back
294 top unit
295 second contact surface
296 cup spring
297 seal
298 safety bolt
299 clearance
300 third embodiment of screw clamp
d1 diameter of the piston
d2 outer diameter of the pneumatic actuator

The invention claimed is:

1. A pneumatic actuator, comprising:

a replaceable gas capsule with a capsule outlet, for supplying a gas under elevated pressure;

a pressure reducer connected with an outlet of the gas capsule, adapted for providing gas under a reduced pressure;

a control valve connected with an outlet of the pressure reducer for receiving the gas under reduced pressure, having a first outlet for selectively supplying the gas to a pneumatic cylinder, and having a second outlet for selectively discharging the gas from the cylinder into the environment;

the pneumatic cylinder with a piston that is movable from a retracted position to an extended position.

2. The pneumatic actuator of claim 1, wherein the pressure reducer is an adjustable pressure reducer, and the adjustable pressure reducer has an adjustment knob for setting a pressure at the outlet of the pressure reducer.

3. The pneumatic actuator of claim 1, wherein the pneumatic cylinder comprises:

a cylinder wall with an internal diameter from 30 to 60 mm; and a piston that is axially movable with respect to the cylinder wall.

4. The pneumatic actuator of claim 1, wherein:

the pneumatic cylinder is a single-acting pneumatic cylinder; and the pneumatic actuator further comprises a spring for at least partially pushing back the piston.

5. The pneumatic actuator of claim 1, wherein:

the outlet of the gas capsule is fluidly connected with the inlet of the pressure reducer via a transition element;

the pressure reducer has an internal screw thread for attaching the transition element, and where the transition element comprises a corresponding external screw thread; and the transition element further comprises an internal screw thread for attaching the gas capsule, and where the gas capsule comprises a corresponding external screw thread; and the transition element further comprises a puncture element for puncturing a portion of the gas capsule when mounting the gas capsule in the transition element, where the puncture element is fluidly connected with the inlet of the pressure reducer.

6. The pneumatic actuator of claim 1, wherein the gas capsule is surrounded by a cylinder-shaped metal casing of at least 1.5 mm thickness and an external diameter from 45 mm to 65 mm.

7. The pneumatic actuator of claim 1, wherein the gas capsule is surrounded by a thermal insulation provided within the aluminium casing.

8. The pneumatic actuator of claim 1, wherein:

the control valve has an internal space that is in fluid connection with the first outlet of the control valve; and the control valve further comprises one single slidable control pin to connect the internal space with either the inlet of the control valve corresponding to a first mode of operation, or with the second outlet of the control valve corresponding to a second mode of operation.

9. The pneumatic actuator of claim 1, wherein:

the control valve comprises a first depressible control pin for connecting the inlet of the control valve and the first outlet of the control valve, and a first spring for pushing back the first control pin to a position where the first outlet is closed off from the inlet;

the control valve further comprises a second depressible control pin for connecting the first outlet and the second outlet of the control valve, and a second spring to push back the second control pin to a position where the first outlet is closed off from the second outlet;

the first mode of operation corresponds to the first control pin being in the depressed position and the second control pin in pushed-back position; and the second mode of operation corresponds to the second control pin being in the depressed position and the first control pin in the pushed-back position.

10. The pneumatic actuator of claim 1, wherein the actuator is implemented such that for each activation and deactivation less than 25 mL gas from the gas capsule is used.

11. The pneumatic actuator of claim 1, wherein the pneumatic actuator without gas capsule has a mass of less than 700 grams.

12. A portable clamping device comprising:

a pneumatic actuator according to claim 1;

a first arm forming part of a guide profile or to which a guide profile is connected, where the guide profile has a linear portion; and a second arm movably attached to the linear portion of the guide profile, the second arm having two through-openings, wherein:

the first arm and the second arm extend substantially perpendicular with respect to the linear portion of the guide profile; and the pneumatic actuator is connected with the second arm and extends in a direction substantially parallel to the linear portion of the guide profile for clamping one or more workpieces.

13. The portable clamping device of claim 12, wherein the first arm has a first contact surface, and the pneumatic actuator has a second contact surface for clamping the one or more workpieces between the first and second contact surface.

14. The portable clamping device of claim 12, wherein the mass of the clamping device is less than 2600 grams.

15. The portable clamping device of claim 12, wherein the clamping device further comprises a safety bolt to block the piston.

16. A method for repairing a clamping device, the method comprising:

providing a clamping device according to claim 12;

removing the gas capsule, if present;

removing the hardened transition element; and screwing in a new hardened transition element.

17. A method for assembling a clamping device, the method comprising:

providing a pneumatic actuator according to claim 1;

providing a guide profile having a linear portion comprising a first arm forming part of the guide profile or, alternatively, providing a guide profile having a linear portion, then connecting a first arm to the guide profile;

providing a second arm having a first opening and a second opening;

connecting the pneumatic actuator to the first opening of the second arm; and inserting the guide profile through the second opening of the second arm.

18. The method of claim 17, further comprising connecting a top unit to the piston or to an extension of the piston.

19. A method for assembling a pneumatic actuator, the method comprising:

providing a body comprising a pressure reducer and a control valve;

inserting at least one control pin, and at least one ball or first element having a collar, and at least one spring in an opening of the body;

sealing the opening at the side of the spring;

screwing in a hardened transition element in the body; and heating a first aluminium casing, and applying the first aluminium casing in heated state around the body, and crimping the first aluminium casing.

20. The method of claim 19, further comprising:

applying a second metal casing against the body, for surrounding the space configured for containing the gas capsule.

* * * * *